US007810900B2

(12) United States Patent
Yamamoto et al.

(10) Patent No.: US 7,810,900 B2
(45) Date of Patent: Oct. 12, 2010

(54) LIQUID EJECTION APPARATUS

(75) Inventors: Taisuke Yamamoto, Nagano-ken (JP); Koji Harada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 930 days.

(21) Appl. No.: 11/657,478

(22) Filed: Jan. 25, 2007

(65) Prior Publication Data

US 2007/0170279 A1 Jul. 26, 2007

(30) Foreign Application Priority Data

Jan. 25, 2006 (JP) ..... 2006-016498
Dec. 19, 2006 (JP) ..... 2006-341523

(51) Int. Cl.
*B41J 2/165* (2006.01)

(52) U.S. Cl. ..... 347/36; 347/32

(58) Field of Classification Search ..... 347/29–36
See application file for complete search history.

(56) References Cited

U.S. PATENT DOCUMENTS 4,819,012 A * 4/1989 Kiyohara et al. ..... 347/30
6,000,775 A * 12/1999 Muraki ..... 347/8
6,318,920 B1 * 11/2001 Silverbrook ..... 400/653
6,869,160 B2 * 3/2005 West et al. ..... 347/28
7,533,958 B2 * 5/2009 Park et al. ..... 347/29
7,575,296 B2 * 8/2009 Yoshida ..... 347/33
2004/0174409 A1 9/2004 Park et al.

FOREIGN PATENT DOCUMENTS

JP 2001-030507 A 2/2001
JP 2002-086762 A 3/2002

* cited by examiner

*Primary Examiner*—Julian D Huffman
*Assistant Examiner*—Jason S Uhlenhake
(74) *Attorney, Agent, or Firm*—Sughrue Mion, PLLC

(57) ABSTRACT

A printer including a recording head, a flushing box and a movement mechanism is disclosed. The recording head has a nozzle-forming surface in which nozzle openings are defined and ejects a liquid through the nozzle openings. The flushing box has an opening corresponding to the nozzle openings and is capable of receiving the liquid ejected from the nozzle opening as a waste liquid. The movement mechanism moves the flushing box between a receiving position at which the flushing box is capable of receiving the waste liquid and a non-receiving position at which the flushing box is incapable of receiving the waste liquid. The receiving position is a position at which the opening is closely opposed to the nozzle-forming surface, and the non-receiving position is spaced from the receiving position.

13 Claims, 13 Drawing Sheets

LIQUID EJECTION APPARATUS

CROSS-REFERENCE TO RELATED APPLICATIONS

This application is based upon and claims the benefit of priority from prior Japanese Patent Application Nos. 2006-016498 filed on Jan. 25, 2006, and 2006-341523 filed on Dec. 19, 2006, the entire contents of which are incorporated herein by reference.

BACKGROUND

The present invention relates to a liquid ejection apparatus.

Generally, an inkjet printer is known as a liquid ejection apparatus that ejects liquid, or ink, onto a target through a nozzle opening defined in a nozzle-forming surface of a recording head. This type of printer has a wiper member that wipes off ink from a nozzle-forming surface of a recording head for maintenance of the recording head. Such wiping may cause variation in meniscuses of ink in multiple nozzle openings. Further, if the amount of the ink ejected from a certain one of the nozzle openings is comparatively small, the viscosity of the ink may increase in the nozzle opening and thus clog the opening. To solve these problems, as described in, for example, JP-A-2002-86762 and JP-A-2001-30507, a printer having a flushing box has been proposed. Specifically, when printing is not performed, ink is forcibly ejected from nozzle openings of a recording head in response to a drive signal unrelated to printing and received by the flushing box.

More specifically, the printer of JP-A-2002-86762 has a guide shaft, which extends along the longitudinal direction of the printer, and a carriage. A recording head is mounted in the carriage, and the carriage reciprocates along the guide shaft. A cap member is arranged at a home position defined at the right end of the printer and capable of sealing a nozzle surface of the recording head by selectively ascending and descending. A flushing area is defined at the left end of the printer and a flushing box is provided in the flushing area. The flushing box receives an ink absorber. Forcible ejection of ink from the nozzle openings of the recording head into the flushing box, or flushing, is carried out when, in printing, the carriage is moved to the flushing area.

The printer of JP-A-2001-30507 has a rotary drum and an arm member. Each of the rotary drums is located below the nozzle-forming surface of the recording head and rotates about a horizontal axis. The arm member is supported by a shaft of the corresponding rotary drum and caused to be moved by rotation of the rotary drum. The flushing box and the associated wiper members are held by the distal end of the corresponding arm member. Specifically, the recording head of the printer is moved to a non-printing position, which is spaced upward from the rotary drum by a predetermined distance. Then, by causing the arm member to wobble through rotation of the rotary drum, the flushing box and the wiper member are moved to a liquid receiving position. The liquid receiving position is immediately below the nozzle surface of the recording head, which is maintained at the non-printing position.

In this state, forcible ejection of the ink from the nozzle openings of the recording head into the flushing box, or flushing, is conducted. Then, by rotating lead screws, the wiper member is caused to contact and slide on the nozzle surface while elastically deforming. The wiper member is thus moved from a wiping position at which the wiper member wipes the nozzle surface to a non-wiping position spaced from the wiping position to perform wiping. Subsequently, by causing the arm member to wobble, the flushing box, together with the wiper member, is moved separately from the recording head and returned to the liquid non-receiving position. Afterwards, the recording head is lowered from the non-printing position and returned to the printing position, which is close to the outer circumferential surface of the rotary drum.

In the printer of JP-A-2002-86762, the flushing area in which the flushing box is fixed is set at a position opposed to the position of the cap member. The printing area is located between the flushing area and the cap member. Such arrangement of the flushing area increases the size of the printer in the longitudinal direction of the carriage by an amount corresponding to the size of the flushing area.

In the printer of JP-A-2001-30507, the wiper member and the flushing box are held at the distal end of the arm member with the wiper member arranged distally from the flushing box. Therefore, in flushing, the nozzle surface of the recording head and the surface of the flushing box facing the nozzle surface are spaced from each other at least by a margin corresponding to the thickness of the wiper member. Although this configuration prevents the printer from enlarging in the longitudinal direction, it may transform the waste ink ejected from the nozzle openings of the recording head into mist by resistance of the air before the waste ink reaches the flushing box. The mist then floats inside the printer and thus contaminates the interior of the printer.

SUMMARY

Accordingly, it is an objective of the present invention to provide a smaller-sized liquid ejection apparatus that suppresses contamination of the interior of the apparatus by waste liquid ejected from nozzle openings of a recording head.

In accordance with one aspect of the present invention, a liquid ejection apparatus including a liquid ejection head, a liquid receiver and a movement mechanism is provided. The liquid ejection head has a nozzle-forming surface in which nozzle openings are defined and ejects a liquid through the nozzle openings. The liquid receiver has an opening corresponding to the nozzle openings and is capable of receiving the liquid ejected from the nozzle opening as a waste liquid. The movement mechanism moves the liquid receiver between a receiving position at which the liquid receiver is capable of receiving the waste liquid and a non-receiving position at which the liquid receiver is incapable of receiving the waste liquid. The receiving position is a position at which the opening is closely opposed to the nozzle-forming surface, and the non-receiving position is spaced from the receiving position.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

An inkjet printer, or an embodiment of a liquid ejection apparatus according to the present invention, will now be described with reference to the attached drawings.

In the description, the directions "up", "down", "right", and "left" will refer to the directions indicated by the corresponding arrows of the drawings.

Figure 1:
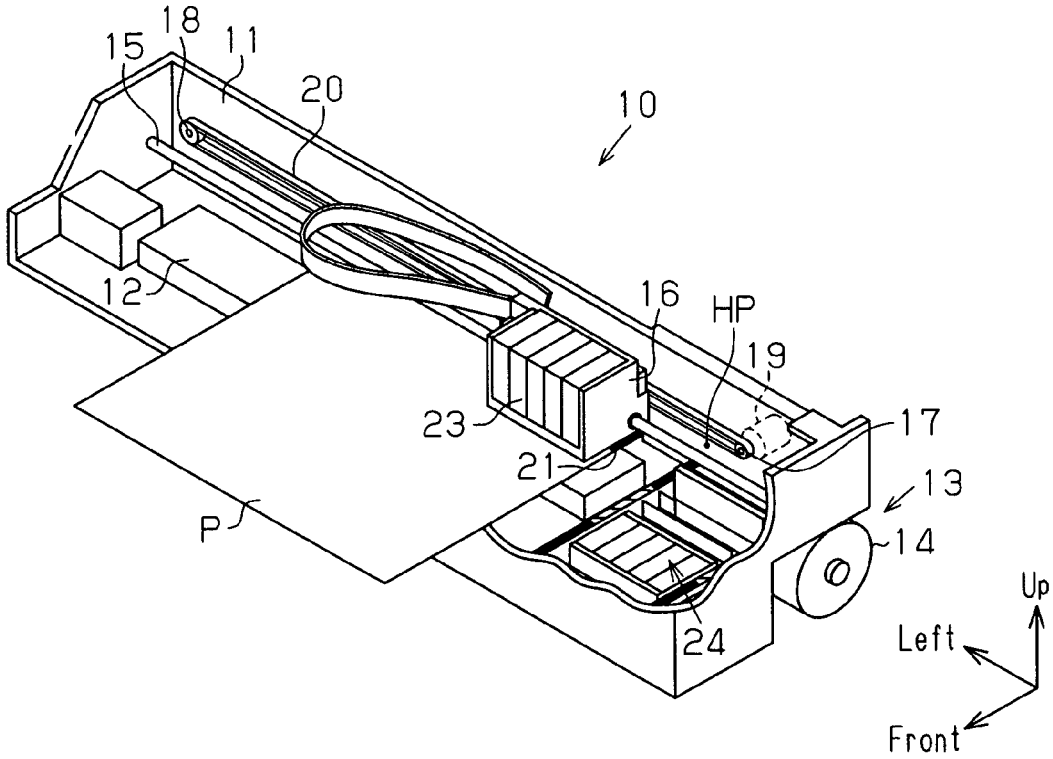
FIG. 1 is a perspective view showing a printer according to an embodiment of the present invention.

As shown in FIG. 1, a printer 10, or a liquid ejection apparatus of the illustrated embodiment, includes a box-like body casing 11. A platen 12 is arranged in a lower portion of the space in the body casing 11 and extends in the longitudinal direction of the body casing 11, or a main scanning direction (a left-and-right direction of FIG. 1). A waste ink tank (not shown) is provided below the platen 12. The platen 12 is a support table that supports a sheet of paper P, which is a target. The platen 12 is driven by the drive force of a paper feeding motor 14 of a paper feeding mechanism 13 and thus moves the paper sheet P in a sub-scanning direction (a front-and-rear direction of FIG. 1) perpendicular to the main scanning direction.

A guide shaft 15 is provided above the platen 12 in the body casing 11 and passes through a carriage 16, thus movably supporting the carriage 16. A drive pulley 17 and a driven pulley 18 are rotatably supported at the positions corresponding to the opposing ends of the guide shaft 15 on a rear surface of the body casing 11. A carriage motor 19 or a drive source that reciprocates the carriage 16 is connected to the drive pulley 17. A timing belt 20 is wound around the two pulleys 17, 18 to fix the carriage 16. This arrangement allows the carriage 16 to move in the main scanning direction through the timing belt 20 while driven by the carriage motor 19 and guided by the guide shaft 15.

Figure 2:
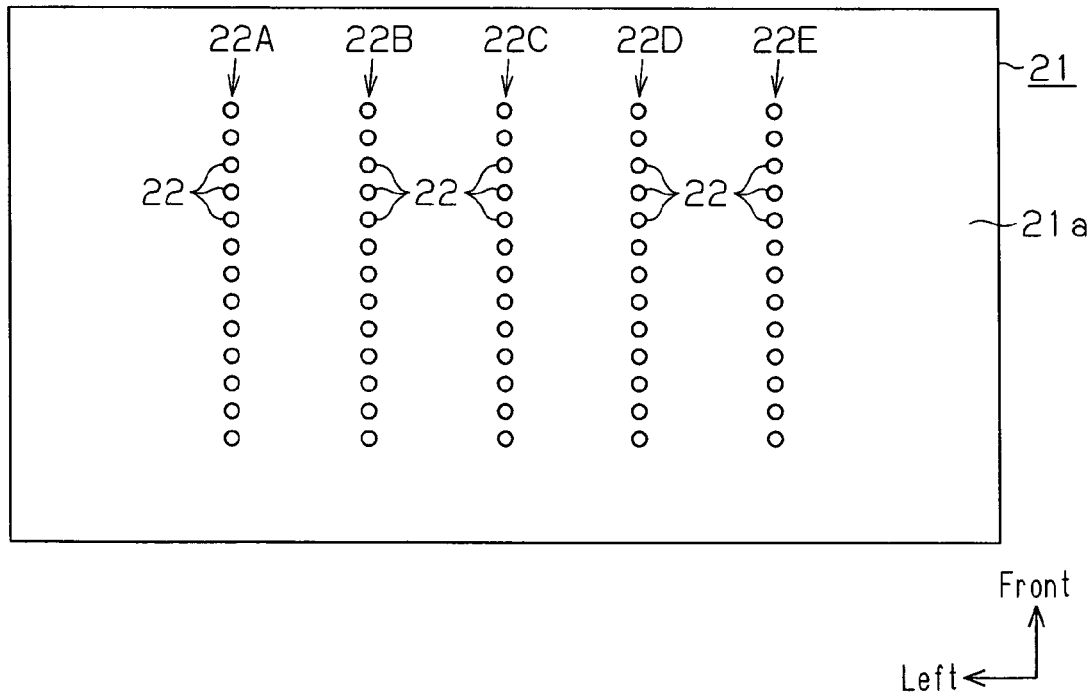
FIG. 2 is a bottom view showing a recording head.

Referring to FIG. 1, a recording head 21, or a liquid ejection head, is provided below the carriage 16. As illustrated in FIG. 2, a plurality of nozzle openings 22 are defined in a lower surface, or a nozzle-forming surface 21*a*, of the recording head 21. The nozzle openings 22 define a plurality of (in FIG. 2, five) nozzle rows 22A, 22B, 22C, 22D, and 22E that are spaced at constant intervals in the left-and-right direction and extend in the front-and-rear direction. In the illustrated embodiment, the nozzle row 22E located rightmost in FIG. 2 is defined by the nozzle openings 22 through which black ink is ejected for monochrome printing. The nozzle rows 22A to 22D are each defined by the nozzle openings 22 through which color ink is ejected for color printing.

With reference to FIG. 1, a plurality of (in the illustrated embodiment, five) ink cartridges 23 are removably mounted on the carriage 16. Each of the ink cartridges 23 corresponds to one of the nozzle rows 22A to 22E, which are defined on the nozzle-forming surface 21*a* of the recording head 21. Each ink cartridge 23 supplies ink to the nozzle openings 22 of the associated nozzle rows 22A to 22E through an ink passage (not shown) defined in the recording head 21. In the illustrated embodiment, the ink cartridge 23 located rightmost in FIG. 1 retains the black ink for the monochrome printing and the other ink cartridges 23 each retain a corresponding color ink for the color printing.

A home position HP is defined in a portion (a right portion of FIG. 1) of the space in the body casing 11, or a non-printing area outside the movement range of the paper sheet P. The home position HP is the space in which the carriage 16 stands by when the printer 10 is turned off or maintenance is performed on the nozzle-forming surface 21*a* of the recording head 21. A maintenance unit 24 is provided below the home position HP and carries out various maintenance operations for maintaining effective ink ejection from the recording head 21 to the paper sheet P.

The configuration of the maintenance unit 24 will hereafter be explained in detail with reference to FIGS. 3 to 14.

Figure 3:
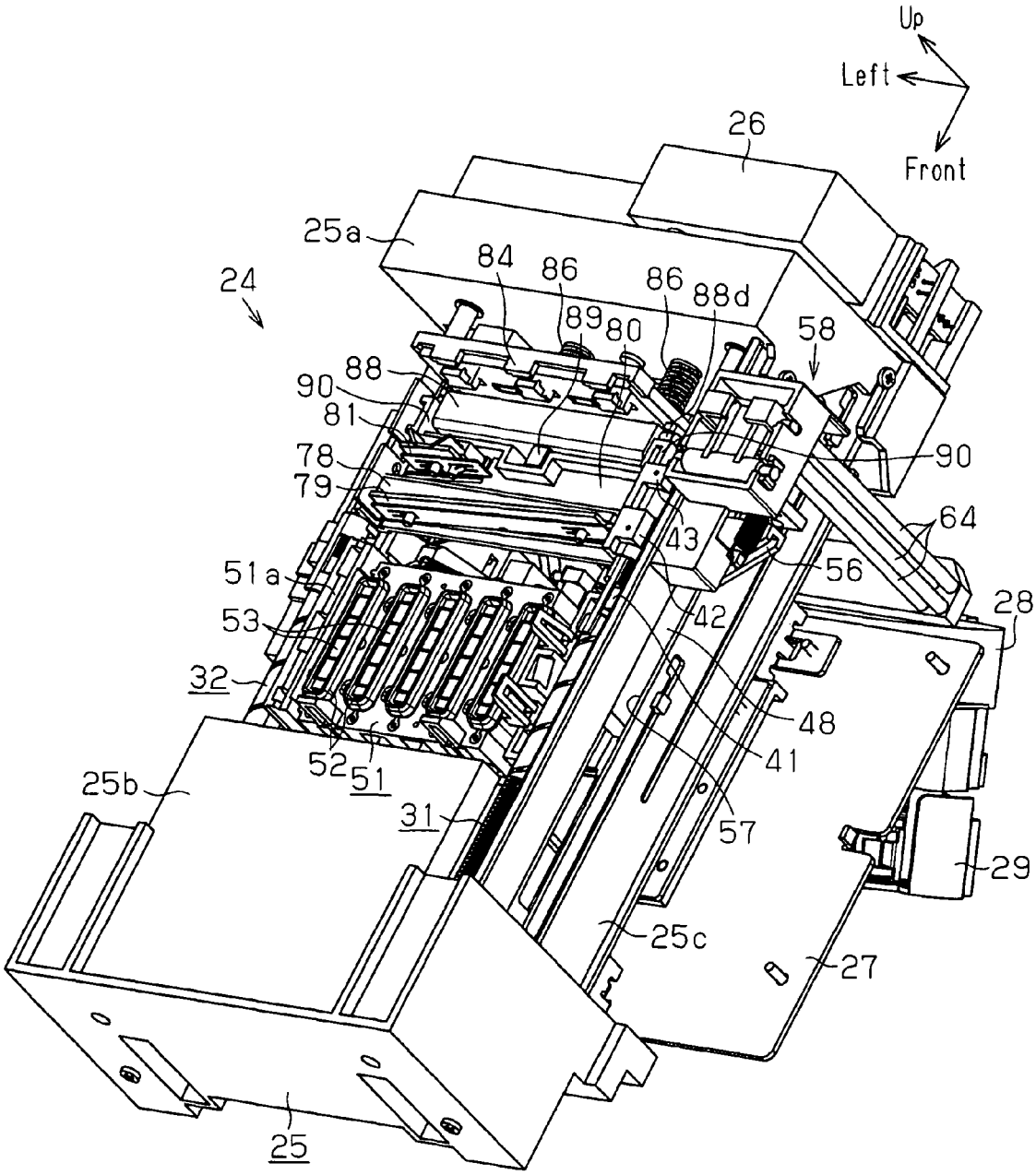
FIG. 3 is a perspective view showing a maintenance unit as viewed from the front right side.
Figure 4:
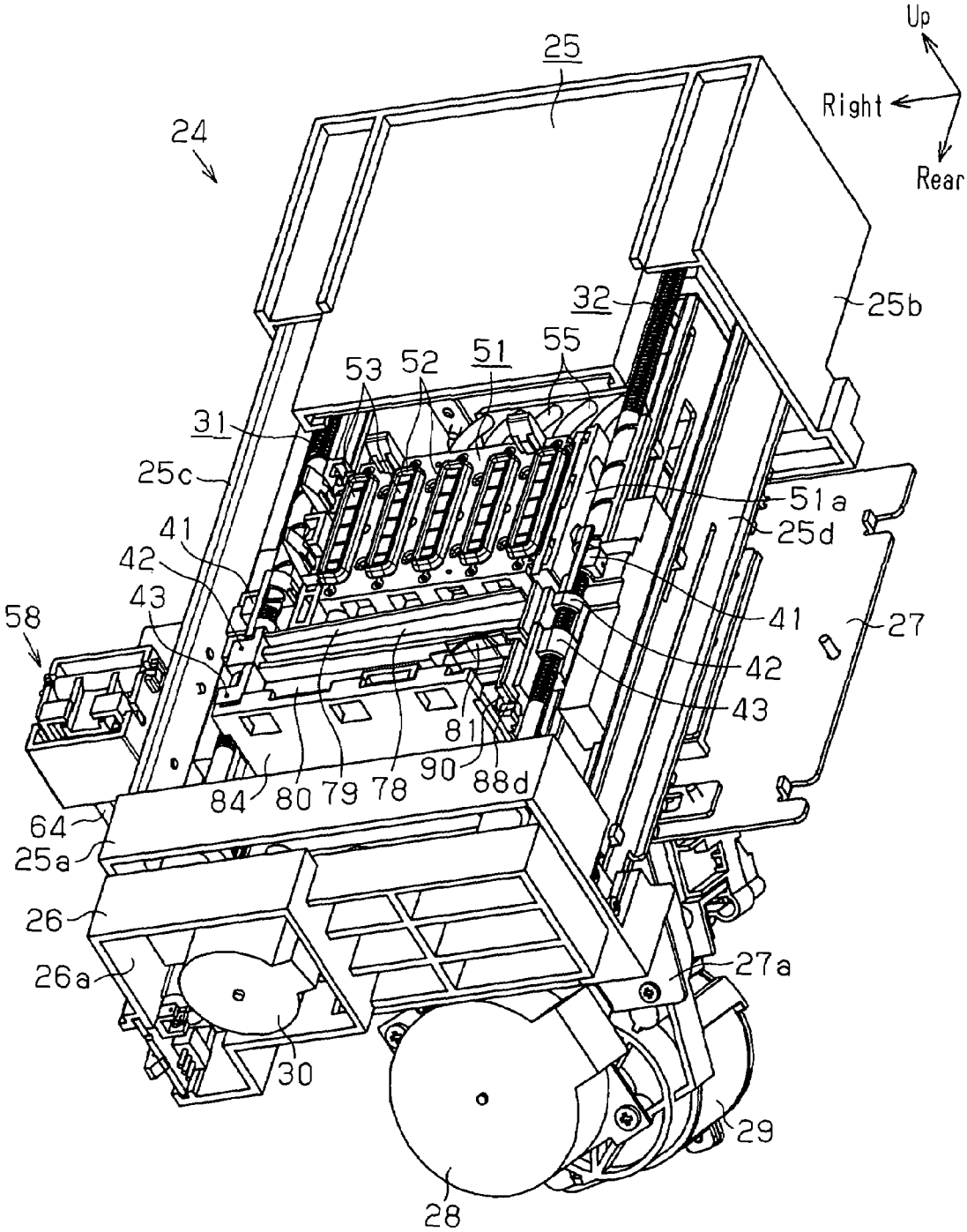
FIG. 4 is a perspective view showing the maintenance unit as viewed from the rear left side.
Figure 5:
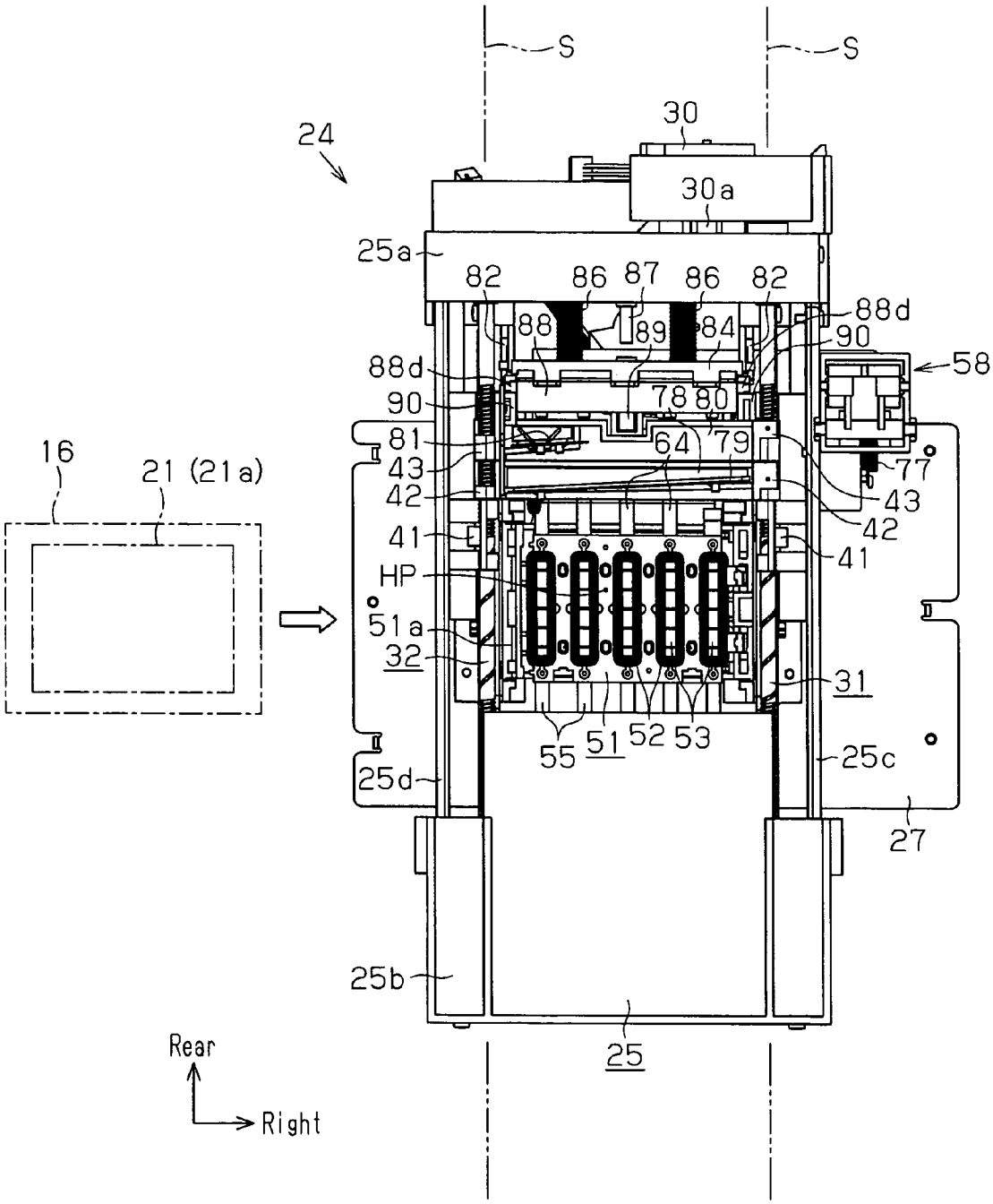
FIG. 5 is a plan view showing the maintenance unit.

With reference to FIGS. 3 to 5, the maintenance unit 24 has a body 25 shaped as a substantially rectangular frame. The body 25 includes a rear casing 25*a*, a front casing 25*b*, a right frame member 25*c*, and a left frame member 25*d*. The rear casing 25*a* has a substantially box-like shape and has a rear opening. The front casing 25*b* has also a box-like shape but larger-sized and has a rear opening. The front-and-rear dimension of the front casing 25*b* is greater than that of the rear casing 25*a*. The right frame member 25*c* connects the casings 25*a*, 25*b* to each other at their respective right ends. The left frame member 25*d* connects the casings 25*a*, 25*b* to each other at their respective left ends. A sub casing 26 is secured to the rear side of the rear casing 25*a* in such a manner as to close the rear opening of the rear casing 25*a*. Referring to FIG. 4, the right half of the space in the sub casing 26 defines a motor receiving recess 26*a*.

Figure 6:
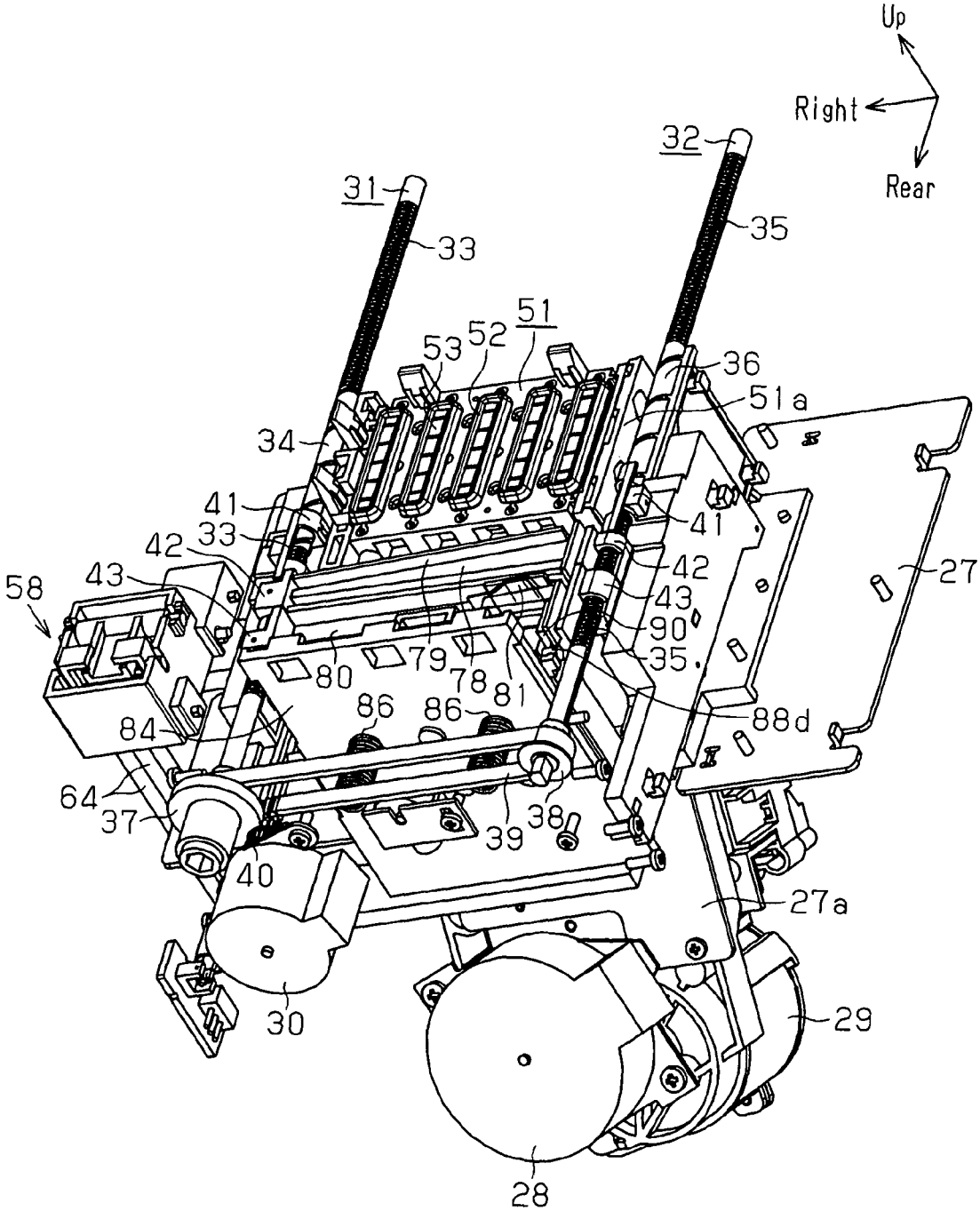
FIG. 6 is a perspective view showing the configuration of the interior of the body of the maintenance unit.

Referring to FIGS. 3 to 5, an attachment plate 27 is arranged below the body 25 and fixed in a horizontal state. The left-and-right dimension of the attachment plate 27 is greater than the dimension of the body 25. With reference to FIGS. 4 and 6, a suction pump 29 formed by a pump motor 28 and a tube pump is supported by the attachment plate 27 through an attachment bracket 27*a* in an inclined state. The suction pump 29 serves as a suction drainage device. The attachment plate 27 is supported by the body casing 11 through a securing member (not shown). In this manner, as illustrated in FIG. 1, the maintenance unit 24 is held in a fixed state at a position below the home position HP in the body casing 11.

As shown in FIGS. 4 and 5, a drive motor 30 is secured to a wall of the motor receiving recess 26*a* of the sub casing 26. The drive motor 30 serves as a drive source and is selectively rotatable in a forward direction and a reverse direction. Referring to FIG. 5, an output shaft 30*a* of the drive motor 30 extends through the sub casing 26 and projects forward. The distal end of the output shaft 30*a* is arranged in the rear casing 25*a*.

Figure 7:
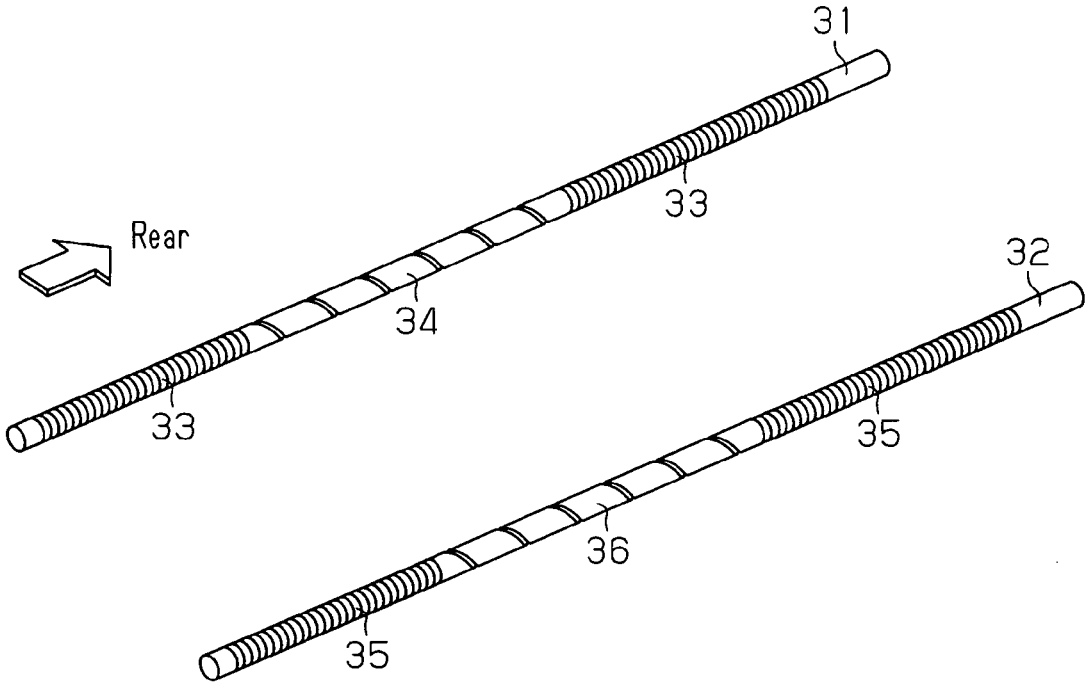
FIG. 7 is a perspective view showing lead screws.

As shown in FIGS. 3 to 5, a right lead screw 31 and a left lead screw 32 are rotatably provided between the rear casing 25*a* and the front casing 25*b* of the body 25. The right lead screw 31 is located above and inward from the right frame member 25*c*, extending horizontally along the front-and-rear direction. The left lead screw 32 is located above and inward from the left frame member 25*d*, extending horizontally along the front-and-rear direction. The right and left lead screws 31, 32 form a drive force transmitting member and a lead member. Referring to FIG. 7, the right lead screw 31 has first threaded portions 33 formed on the outer circumferential surfaces of the longitudinal front and rear end portions of the lead screw 31. The right lead screw 31 also has a second threaded portion 34 formed on the outer circumferential surface of a substantial longitudinal middle portion of the lead screw 31. Similarly, the left lead screw 32 has first threaded portions 35 formed on the outer circumferential surfaces of the longitudinal front and rear end portions of the lead screw 32 and a second threaded portion 36 formed on the outer circumferential surface of a substantial longitudinal middle portion of the lead screw 32. The pitch of each of the first threaded portions 33, 35 is smaller than the pitch of each of the second threaded portions 34, 36. The rear end of the right lead screw 31 and the rear end of the left lead screw 32 are received in the rear casing 25*a*.

FIG. 6 shows the maintenance unit 24 of FIG. 4 without the body 25 and the sub casing 26. A synchronous pulley 37 and a synchronous pulley 38 are secured to the rear end of the lead screw 31 and the rear end of the lead screw 32, respectively. An endless pinion belt 39 is wound around the pulleys 37, 38. The pulley 37, which is secured to the rear end of the right lead screw 31, is connected to the distal end of the output shaft 30*a* of the drive motor 30 through a transmission gear 40 in such a manner as to allow transmission of the drive force. Therefore, when the drive motor 30 runs and generates the drive force, the right and left lead screws 31, 32 synchronously rotate in the same directions about the corresponding axes S (see FIG. 5).

Figure 8:
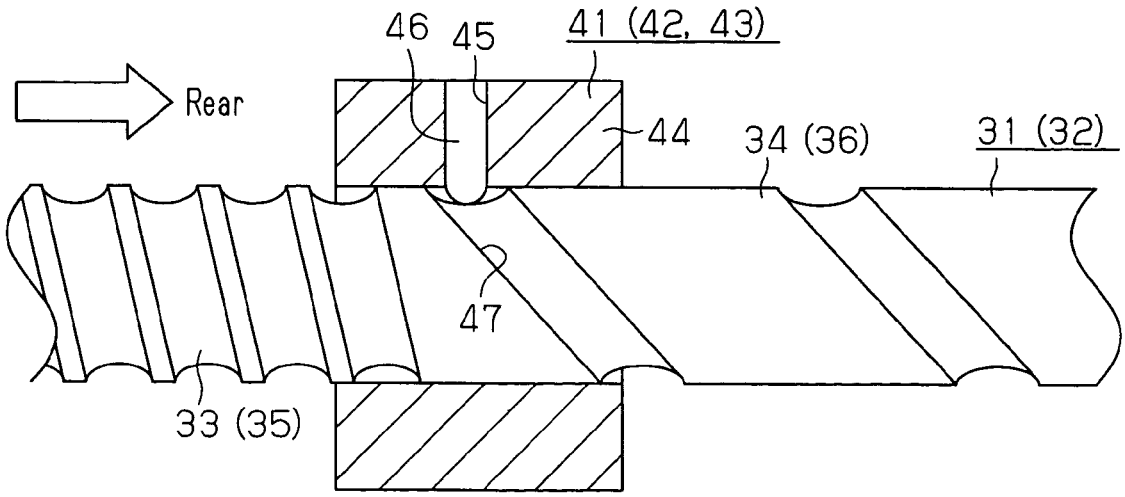
FIG. 8 is a cross-sectional view showing the lead screw and a cylindrical portion of a movable member in a mutually engaged state.

With reference to FIGS. 3 to 6, a plurality of movable members 41, 42 and 43 are provided around each of the right and left lead screws 31, 32 along the direction of the axes S. In the illustrated embodiment, a total of six movable members, which are a pair of movable members 41, a pair of movable members 42, and a pair of movable members 43, are employed. In other words, each of the movable members 41, the associated one of the movable members 42, and the associated one of the movable members 43 are arranged around the common one of the lead screws 31, 32. With reference to FIG. 8, each of the movable members 41, 42 and 43 has a cylindrical portion 44 at which the movable member 41, 42 and 43 is engaged with the corresponding lead screws 31, 32. A bore 45 radially extends through a portion of the cylindrical portion 44. A pin 46, as an engagement portion, is fitted in each of the bores 45.

The distal end of the pin 46 of each cylindrical portion 44 is engaged with a spiral threaded groove 47, which is provided continuously from the first threaded portions 33, 35 to the second threaded portion 34, 36 of the associated lead screws 31, 32. The pins 46 are guided by the threaded groove 47 when the lead screws 31, 32 rotate. Thus, each pair of the movable members 41, 42 and 43 move sequentially along the same directions of the axes S of the lead screws 31, 32. Specifically, the pitch of each threaded groove 47, which guides the corresponding pin 46, varies along the direction of the axis S of the associated lead screw 31, 32. The movement speed of each movable member 41 to 43 thus varies in accordance with variation of the pitch of the threaded groove 47. In other words, each movable member 41 to 43 moves at a relatively low speed when moving along the corresponding first threaded portion 33, 35, the pitch of which is relatively small, and at a relatively high speed when moving along the corresponding second threaded portion 34, 36, the pitch of which is relatively great.

The movable members 41 to 43 are mutually spaced along the direction of the axis S of the associated lead screw 31, 32. Such spacing prevents two or more pairs of the movable members 41 to 43 from becoming engaged with the second threaded portions 34, 36 at one time. Any single pair of the movable members 41 to 43 are thus permitted to become engaged with the second threaded portions 34, 36. In other words, the number of the pitches between the pins 46 of each adjacent pair of the movable members 41 to 43 is greater than the number of the pitches of each second threaded portion 34, 36. Therefore, as long as any one of the pairs of the movable members 41 to 43 are engaged with the second threaded portions 34, 36 through rotation of the lead screws 31, 32, the other pairs of the movable members 41 to 43 are prevented from becoming engaged with the second threaded portions 34, 36. As a result, solely the pair of the movable members 41 to 43 that are engaged with the second threaded portions 34, 36 are allowed to move relatively rapidly.

In the illustrated embodiment, when the drive motor 30 runs in the forward direction, each of the lead screws 31, 32 rotates in a forward direction in such a manner that the movable members 41 to 43 then proceed from the rear casing 25*a* toward the front casing 25*b*. Contrastingly, when the drive motor 30 rotates in the reverse direction, each lead screw 31, 32 rotates in a reverse direction in such a manner that the movable members 41 to 43 retreat from the front casing 25*b* toward the rear casing 25*a*. In the illustrated embodiment, the lead screws 31, 32 and the movable members 41 to 43 form a drive force transmission device. Particularly, the lead screws 31, 32 and the movable members 43 form a liquid receiver movement mechanism.

The movable members 41, which are located foremost of the movable members 41 to 43 in the directions of the axes S of the lead screws 31, 32, are provided for moving a cap member 51 and a valve body 66, which will be explained later.

The movable members 41 transmit the drive force produced through rotation of the lead screws 31, 32 to the cap member 51 and the valve body 66. The movable members 42, which are located the second foremost in the directions of the axes S of the lead screws 31, 32, are employed for moving a wiper member 79, which will be explained later. The movable members 42 transmit the drive force generated through rotation of the lead screws 31, 32 to the wiper member 79. The movable members 43, which are located rearmost in the directions of the axes S of the lead screws 31, 32, are provided for moving the wiper member 81 and a liquid receiver (a flushing box 88), which will be explained later. The movable members 43 transmit the drive force generated through rotation of the lead screws 31, 32 to the wiper member 81 and the liquid receiver.

First, the movable members 41, which move the cap member 51 and the valve body 66, will be explained.

As shown in FIGS. 9A to 11B, a substantially rectangular plate 48, which extends in the front-and-rear direction, is formed integrally with each of the movable members 41. Each of the plates 48 extends downward from the associated one of the movable members 41 at a position inward from the corresponding one of the right and left frame members 25*c*, 25*d*. An elongated guide bore 49 is defined in each plate 48 and serves as an associating portion that associates the corresponding movable member 41 with the cap member 51. With reference to FIGS. 9A to 11B, each of the guide bores 49 has a rear horizontal portion 49*a*, an inclined portion 49*b*, and a front horizontal portion 49*c*. The rear horizontal portion 49*a* extends horizontally from a lower portion at the rear end to a substantial middle portion of the plate 48 in the front-and-rear direction of the plate 48. The inclined portion 49*b* extends diagonally from the front end of the rear horizontal portion 49*a* toward the vicinity of an upper portion at the front end of the plate 48. The front horizontal portion 49*c* extends horizontally from the front end of the inclined portion 49*b* to the upper portion at the front end of the plate 48.

Referring to FIGS. 9A to 11B, a holder member 50, which is shaped like a rectangular frame and has an upper opening, is provided inward from the plates 48 and at the positions corresponding to the second threaded portions 34, 36 of the lead screws 31, 32. A cap member 51 is received in the holder member 50 in a state accommodated in a cap holder 51*a* shaped like a box having a closed bottom. In this state, the cap member 51 is movable in the up-and-down direction together with the cap holder 51*a*. A coil spring (not shown) is arranged between a lower surface of the cap member 51 and an inner bottom surface of the cap holder 51*a* in such a manner as to urge the cap member 51 upward. In FIGS. 9A to 11B, the maintenance unit 24 is schematically illustrated as viewed from the left side. Therefore, only the left lead screw 32 and the associated threaded portions 35, 36 are shown in the drawings.

The cap member 51 will hereafter be explained.

With reference to FIGS. 3 to 6 and 9A to 11B, the cap member 51 has a substantially rectangular box shape. A plurality of (in the illustrated embodiment, five) rectangular seal portions 52 are formed on an upper surface of the cap member 51. Each of the seal portions 52 corresponds to one of the nozzle rows 22A to 22E, which are defined on the nozzle-forming surface 21*a* of the recording head 21. A cap small chamber (not shown) is defined in each of the seal portions 52 and receives an ink absorber 53. The ink absorbers 53 absorb and retain the ink ejected from the nozzle openings 22 of the corresponding nozzle rows 22A to 22E.

With reference to FIGS. 9A to 9C, and 10, a projection 54 projects horizontally and outwardly from each of the left and right side walls of the cap holders 51*a*. Each of the projections 54 is engaged with the guide bore 49 of the corresponding plate 48, which is formed integrally with the associated movable member 41. When the movable members 41 (and the plates 48) are moved in the front-and-rear direction through rotation of the lead screws 31, 32, the projections 54 projecting from the cap holder 51*a* slide in the guide bores 49 of the plates 48. Particularly, the projections 54 move in the up-and-down direction when sliding along the inclined portions 49*b* of the guide bores 49.

That is, the cap member 51 is located at a sealing position, or an uppermost position, when the projections 54 of the cap holder 51*a* are engaged with the front horizontal portions 49*c* of the guide bore 49 of the plates 48. In this state, the nozzle-forming surface 21*a* of the recording head 21 can be sealed through tight contact with the seal portions 52. Contrastingly, the cap member 51 is located at a non-sealing position, or a lowermost position spaced from the nozzle-forming surface 21*a* of the recording head 21, when the projections 54 of the cap holder 51*a* are engaged with the rear horizontal portions 49*a* of the guide bore 49 of the plates 48. The sealing position corresponds to a contacting position at which the cap member 51 is capable of contacting the recording head 21. The non-sealing position corresponds to a non-contacting position at which the cap member 51 is incapable of contacting the recording head 21.

When the lead screws 31, 32 rotate and the movable members 41 move along the second threaded portions 34, 36, the projections 54 of the cap holder 51*a* are slidably guided by the inclined portions 49*b* of the guide bores 49 of the plates 48, which move integrally with the movable members 41. This selectively raises and lowers the cap member 51 between the sealing position and the non-sealing position in association with the movement of the movable members 41.

As shown in FIGS. 4 and 5, ink drainage tubes 55, or liquid passages, extend from the front wall of the cap member 51. Each of the ink drainage tubes 55 corresponds to one of the cap small chambers in which the ink absorbers 53 are received. Each ink drainage tube 55 is routed into the suction pump 29 that is supported by the attachment plate 27 at a position below the body 25. When the cap member 51 is located at the sealing position and the suction pump 29 is activated, the waste ink is drawn from the cap small chambers through the corresponding ink drainage tubes 55 and discharged into the waste ink tank (not shown) that is arranged in a lower portion of the space in the body casing 11.

With reference to FIGS. 3, 12, and 13, a pressing piece 56, which has a substantially triangular shape as viewed from above, projects horizontally from an outer side surface of the plate 48 that is located inward from the right frame member 25*c* of the body 25. The pressing piece 56 serves as an associating portion that associates the movable member 41 with the valve body 66. The pressing piece 56 extends through a cutout groove 57, which is defined in the right frame member 25*c* and extends in the front-and-rear direction, and projects to the exterior of the body 25. When the lead screws 31, 32 rotate and the movable members 41 and then the plates 48 move in the front-and-rear direction, the pressing piece 56 moves in the front-and-rear direction together with the movable members 41 and the plates 48 to operate an air exposure valve device 58 including the valve body 66.

Hereinafter, the air exposure valve device 58 including the valve body 66 will be explained.

As particularly shown in FIG. 3, the air exposure valve device 58 is arranged outside the rear end of the right frame member 25*c* of the body 25. The air exposure valve device 58 is located on the movement path of the pressing piece 56 projecting from the associated movable member 41, which has been described above. As shown in FIGS. 12A to 13B, the air exposure valve device 58 has a rectangular box-like casing portion 59 fixed to the right frame member 25*c* of the body 25. A rectangular opening 61 is defined in a bottom wall 60 of the casing portion 59 to be sized to extend substantially a front half of the bottom wall 60.

Figure 13A:
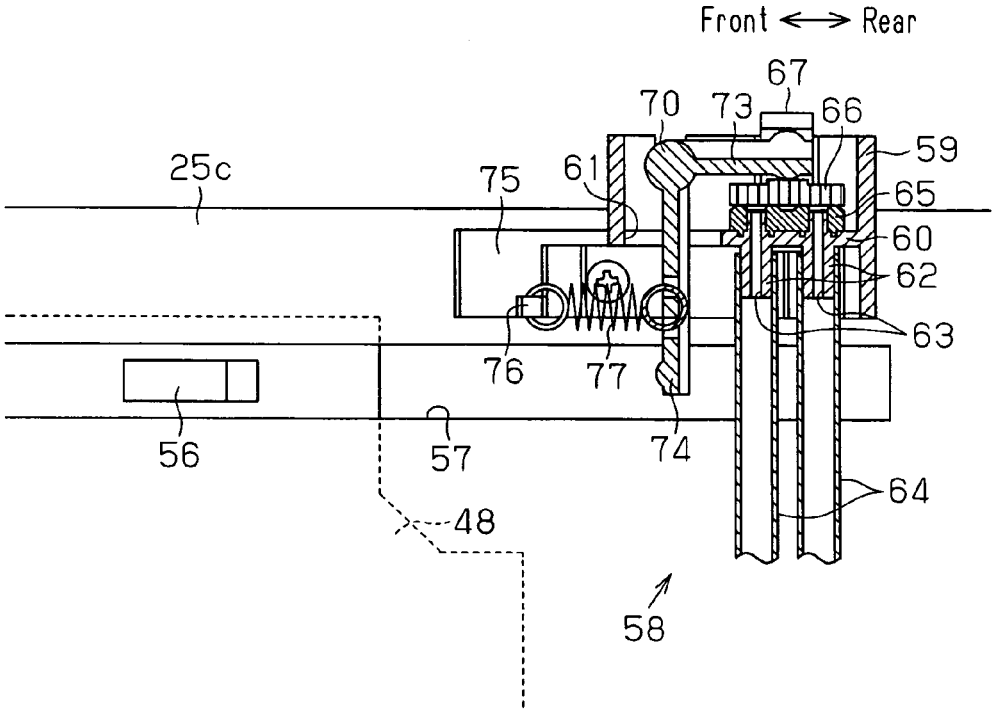
FIG. 13A is a cross-sectional view taken along line 13A-13A of FIG. 12A.
Figure 13B:
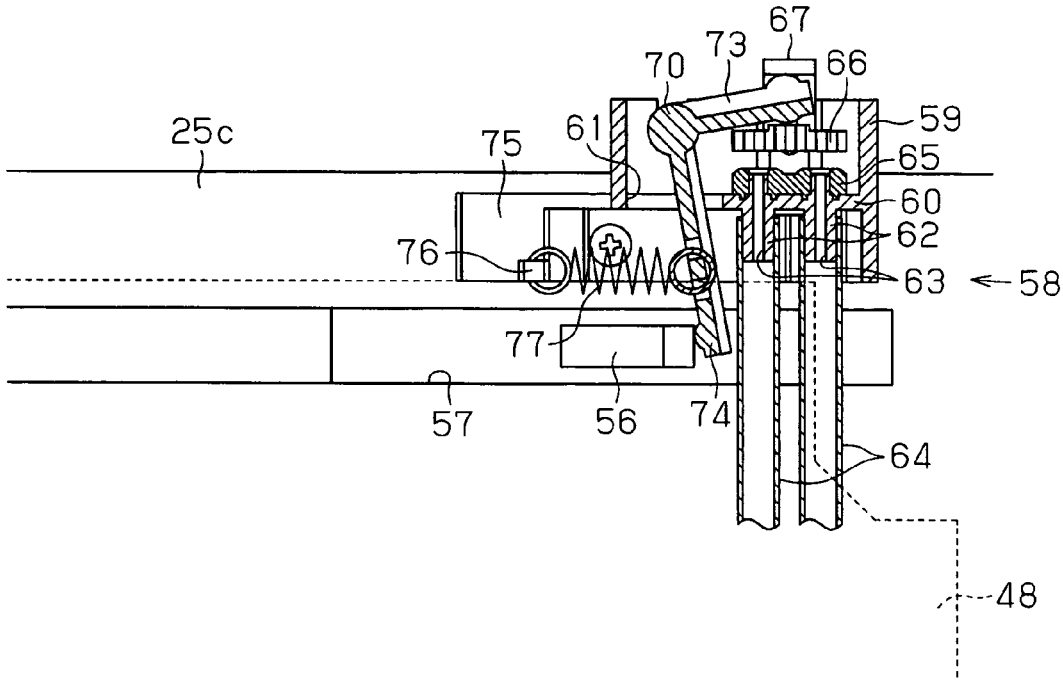
FIG. 13B is a cross-sectional view showing a state in which the pressing valve is retracted from the state of FIG. 13A.

Referring to FIGS. 13A and 13B, a plurality of (in the illustrated embodiment, five) cylindrical portions 62 are provided on the bottom wall 60 of the casing portion 59. One of the opposing ends of each of the cylindrical portions 62 projects upward and the other projects downward. Each cylindrical portion 62 defines an atmospheric or air exposure hole 63. The upper end of an air tube 64 is connected to the lower end of each cylindrical portion 62, which extends downward from a lower surface of the bottom wall 60. With reference to FIG. 5, the lower end of each air tube 64 is routed into the rear wall of the cap member 51 and communicates with the corresponding cap small chamber.

Figure 12A:
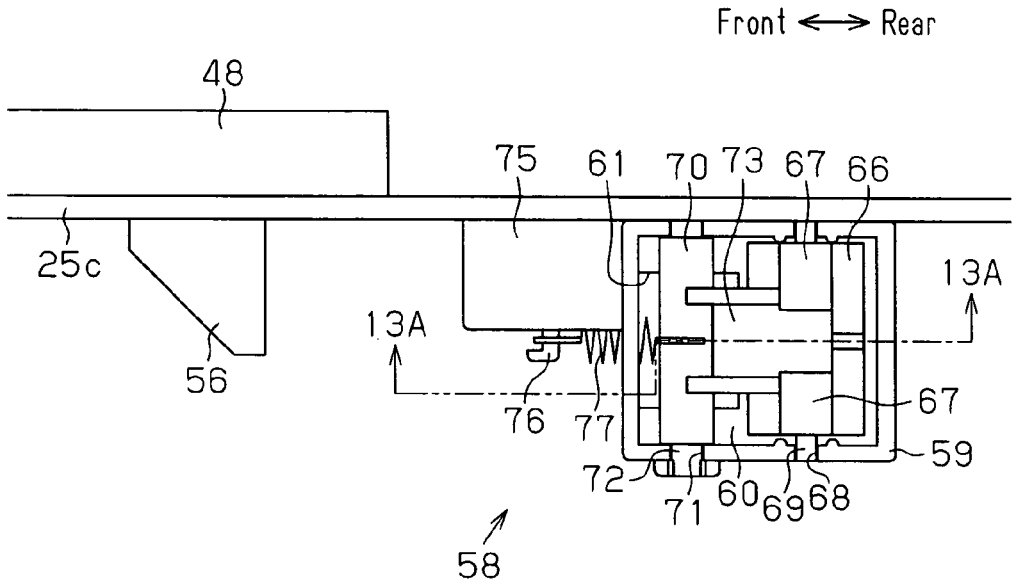
FIG. 12A is a plan view showing the relative positions of an air exposure valve device and a pressing valve.

A valve seat 65 formed of elastic material such as rubber is secured to the upper end of each cylindrical portion 62 that projects from an upper surface of the bottom wall 60 in such a manner as to ensure communication between the air exposure hole 63 and the air. As shown in FIGS. 12A, 13A, and 13B, the valve body 66 having a rectangular plate-like shape is mounted on each of the valve seats 65. A pair of hook-like engagement pieces 67 are provided on an upper surface of each valve body 66 and at opposing sides of the valve body 66, as opposed to each other in a symmetrical manner.

Figure 12B:
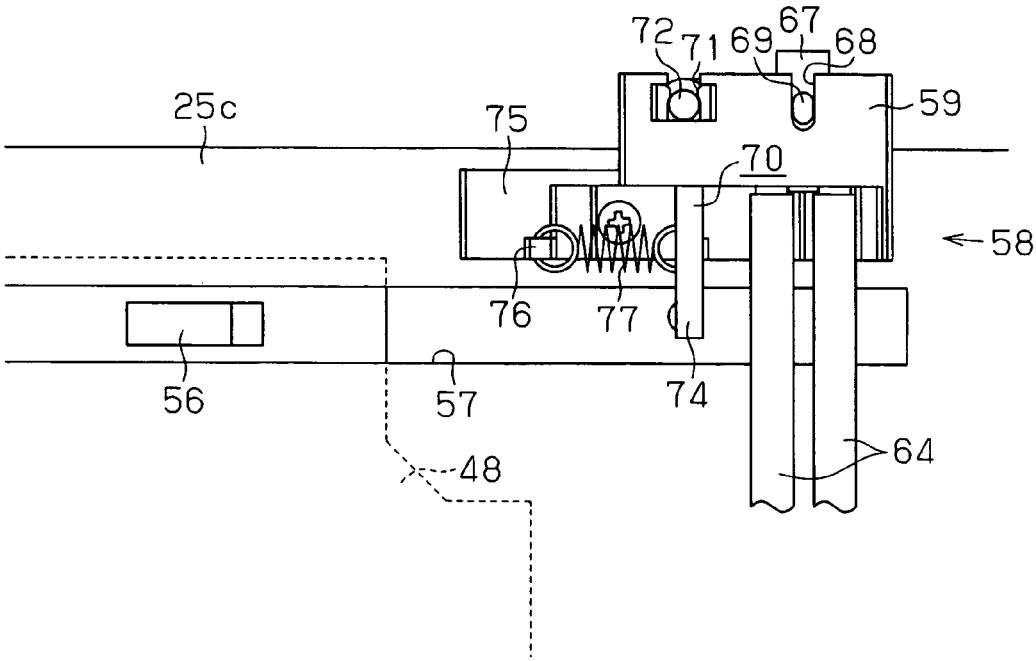
FIG. 12B is a front view corresponding to FIG. 12A.

As shown in FIGS. 12A and 12B, a projection 69 projects from an outer surface of each engagement piece 67 and is engaged with a cutout groove 68, which extends downward from the upper end of the casing portion 59. The projection 69 slides along the cutout groove 68 in the up-and-down direction. This moves the associated valve body 66 between an upper position, or an opening position, and a closing position (a lower position). When located at the opening position, the valve body 66 permits communication between the corresponding ink drainage tube 55, to which the valve body 66 is connected through the air tube 64 and the cap small chamber, and the air. When located at the closing position, the valve body 66 prohibits such communication.

A support groove 71 is defined at the upper end of the casing portion 59 at a position forward from the cutout groove 68 in the casing portion 59. The support groove 71 supports a lever member 70 that moves for selectively opening and closing the valve body 66. With reference to FIGS. 13A and 13B, the lever member 70 has an inverse L-shaped cross section. A projection 72 horizontally projects from each of the opposing right and left ends of the bent portion of the lever member 70 and is engaged with the support groove 71. In this manner, the lever member 70 is supported by the casing portion 59 of the air exposure valve device 58 in such a manner as to allow movement of the lever member 70.

A horizontal arm 73 extends backward from the bent portion of the lever member 70 while a suspended arm 74 extends vertically from the bent portion. Specifically, the horizontal arm 73 extends between the valve body 66 and the upper ends of the engagement pieces 67 and reaches the position behind the engagement pieces 67. The suspended arm 74 extends through the opening 61 defined in the bottom wall 60 of the casing portion 59 and reaches a lower position, or the position crossing the movement path of the pressing piece 56 of the movable member 41.

As shown in FIGS. 12A to 13B, a seat 75 having a parallelepiped shape is secured to a portion of the right frame member 25*c* of the body 25 in the vicinity of the front side of the casing portion 59. A hook-like portion 76 projects from a side surface of the seat 75. A coil spring 77 is provided between the hook-like portion 76 and the suspended arm 74 of the lever member 70. Normally, referring to FIG. 13A, the urging force of the coil spring 77 maintains the lever member 70 in a state in which the suspended arm 74 extends vertically with the horizontal arm 73 slightly spaced downward from the engagement pieces 67 of the valve body 66 held at the closing positions.

Meanwhile referring to FIG. 13B, if the pressing piece 56 retreats together with the movable members 41 and presses the suspended arm 74 against the urging force of the coil spring 77, the lever member 70 rotates about the projection 72. In this state, the horizontal arm 73 becomes engaged with the engagement pieces 67 to raise each valve body 66 from the closing position to the opening position. In this manner, the suspended arm 74 of the lever member 70 of the air exposure valve device 58 is selectively pressed by and released from the pressing piece 56 that moves integrally with the movable members 41. This selectively raises and lowers the valve body 66 between the lower closing positions and the upper opening positions in association with the movement of the movable members 41. In the illustrated embodiment, the pressing piece 56 presses the suspended arm 74 of the lever member 70 of the air exposure valve device 58 when the movable members 41 retreat backward along the rear first threaded portions 33, 35 of the lead screws 31, 32.

The movable members 42 for moving the wiper member 79 will be explained later.

As shown in FIGS. 3 to 6, a wiper holder 78 connects the two movable members 42. The wiper holder 78 serves as an associating member that associates the movable member 42 with the wiper member 79. The wiper member 79 is secured to an upper surface of the wiper holder 78 and extends along the entire longitudinal direction of the wiper holder 78 and in a slightly diagonal direction. When the lead screws 31, 32 rotate and the movable members 42 and the wiper holder 78 move in the front-and-rear direction, the wiper member 79 moves in the front-and-rear direction in association with the movable members 42 and the wiper holder 78.

The wiper member 79 is an all-row wiper and moves in the front-and-rear direction with its distal end or upper end sliding on the nozzle-forming surface 21*a* of the recording head 21. In this manner, the wiper member 79 wipes the entire nozzle-forming surface 21*a* throughout the nozzle rows 22A to 22E that are defined on the nozzle-forming surface 21*a*. Therefore, when the movable members 42 are moved along the second threaded portions 34, 36 through rotation of the lead screws 31, 32 with the carriage 16 and the recording head 21 maintained at the home position HP, the wiper member 79 wipes the entire nozzle-forming surface 21*a* of the recording head 21.

The movable members 43 for moving the wiper member 81 and a liquid receiver will hereafter be explained.

Referring to FIGS. 3 to 6, a wiper holder 80 connects the two movable members 43. The wiper holder 80 serves as an associating member that associates the movable member 43 with the wiper member 81 and a liquid receiver. The wiper member 81 is secured to an upper surface of the wiper holder 80 in the vicinity of the left end of the wiper holder 80 in the longitudinal direction of the wiper holder 80. When the lead screws 31, 32 rotate and the movable members 43 and the wiper holder 80 move in the front-and-rear direction, the wiper member 81 moves in the front-and-rear direction in association with the movable members 43 and the wiper holder 80.

The wiper member 81 is a single-row wiper and moves in the front-and-rear direction with the distal end or the upper end of the wiper member 81 sliding on the nozzle-forming surface 21*a* of the recording head 21. In this manner, the wiper member 81 exclusively wipes an area including any one of the nozzle rows 22A to 22E defined on the nozzle-forming surface 21*a*, or a portion of the nozzle-forming surface 21*a*. Therefore, before operating the single-row wiper member 81, the position of the carriage 16 and the position of the recording head 21 are adjusted at the home position HP in the left-and-right direction in such a manner that one of the nozzle rows, which is a target of wiping, is located in correspondence with the movement path of the wiper member 81 in the front-and-rear direction. Then, when the movable members 43 are moved along the second threaded portions 34, 36 through rotation of the lead screws 31, 32, the wiper member 81 wipes the corresponding portion of the nozzle-forming surface 21*a* of the recording head 21 or only the area corresponding to the single nozzle row, which is the target of wiping.

As shown in FIGS. 5 and 9A to 11B, a pair of support pieces 82 project forward from the front wall of the rear casing 25*a* of the body 25. A cutout groove 83 having a hook-like shape extends backward from the top of the distal end of each of the support pieces 82. A rectangular seal plate 84 that has a front seal surface is arranged between the left and right support pieces 82. Shaft portions 85 project horizontally from the opposing left and right sides of the seal plate 84. Each of the shaft portions 85 is engaged with the cutout groove 83 of the corresponding one of the support pieces 82 in such a manner as to allow pivoting of the seal plate 84 about the shaft portions 85 or the pivotal center.

Coil springs 86 are provided between the front surface of the rear casing 25*a* and a rear surface of the seal plate 84 and above the support pieces 82. The urging force generated by the coil springs 86 constantly urges the seal plate 84 to pivot about the shaft portions 85 or the pivotal center in a clockwise direction of FIGS. 9A to 11B. A projection 87, which serves as a stopper, projects forward from the front surface of the rear casing 25*a* at a position lower than the support pieces 82. A lower portion of the rear surface of the seal plate 84 contacts the projection 87 when the seal plate 84 is urged to pivot by the coil springs 86. This prevents the seal plate 84 from further pivoting.

Figure 14:
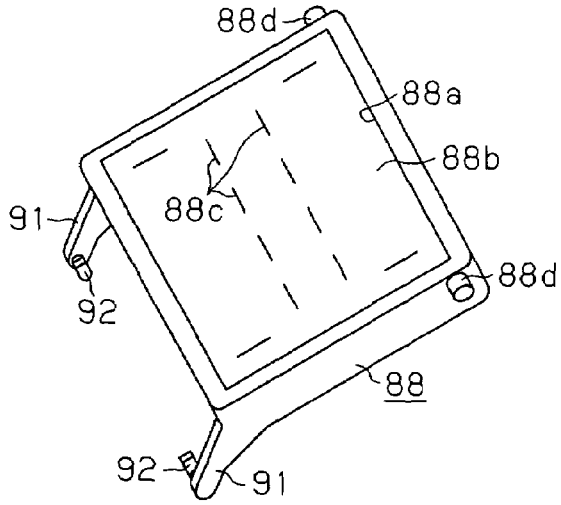
FIG. 14 is a perspective view showing the flushing box.

As shown in FIGS. 3, 5, and 9A to 11B, a flushing box 88, which forms the liquid receiver, is provided between the seal plate 84 and the wiper holder 80. As shown in FIG. 14, the flushing box 88 is a box having a closed bottom and has a rectangular opening 88*a* defined in correspondence with the nozzle-forming surface 21*a* of the recording head 21. A liquid absorber 88*b* is received in the flushing box 88 with a wire 88*c* stopping the liquid absorber 88*b* from falling from the flushing box 88. The liquid absorber 88*b* is formed of the same material as the ink absorbers 53 accommodated in the cap small chambers of the aforementioned cap member 51.

With reference to FIGS. 3 and 5, an end of a waste liquid tube 89, which forms a liquid drainage line, is connected to a substantial center of one side of the bottom of the flushing box 88 so that the waste liquid tube 89 communicates with the interior of the flushing box 88. The opposing end of the waste liquid tube 89 is routed into the suction pump 29 and then the waste ink tank (not shown), which is provided in the lower portion of the space in the body casing 11.

Referring to FIG. 14, a pair of pin portions 88*d* project horizontally at an end of the flushing box 88. The pin portions 88*d* are pivotally supported by the two support pieces 90 that project backward from the left and right ends of the aforementioned wiper holder 80. Through such arrangement, the flushing box 88 is supported by the wiper holder 80 pivotally about the pin portions 88*d*.

Figure 9A:
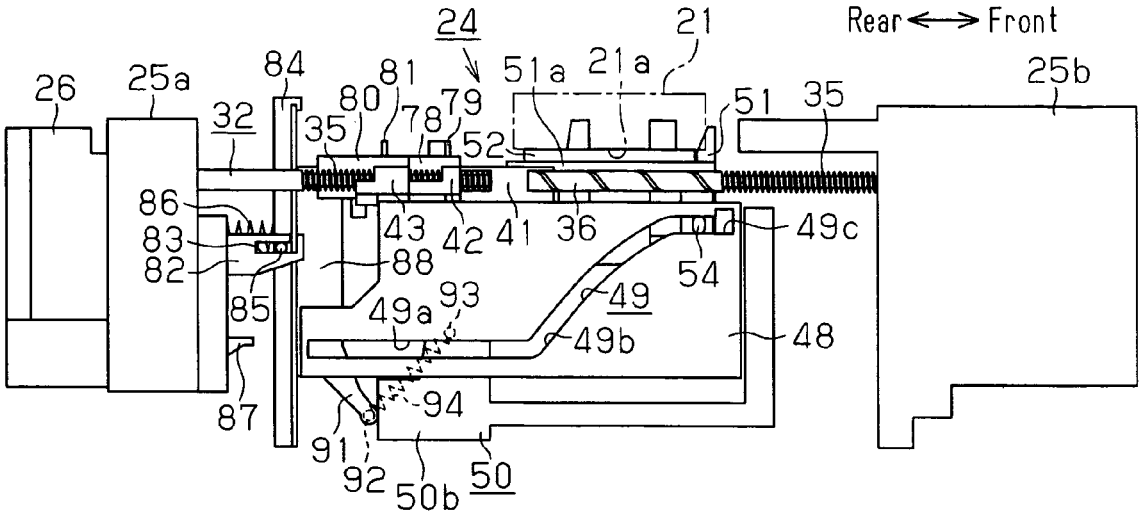
FIG. 9A is a view schematically showing the maintenance unit when a cap member is located at a sealing position.

As illustrated in FIGS. 3, 5, and 9A, when the flushing box 88 is not in operation, or not receiving the ink from the recording head 21, the flushing box 88 is held at a non-receiving position while maintained in a substantially vertical posture. When located at the non-receiving position, the opening 88*a* is oriented laterally and faced backward and thus blocked by the front surface of the seal plate 84. This prevents dryness and solidification of the ink retained by the liquid absorber 88*b* in the flushing box 88.

Referring to FIG. 14, a pair of plate-like leg portions 91 are formed integrally with the opposing end of the flushing box 88. The leg portions 91 project diagonally outward from the bottom surface of the flushing box 88. Pin portions 92 project horizontally from the inner sides of the distal ends of the leg portions 91. The aforementioned holder member 50 has a pair of plate-like support pillar portions 50*a* that project from the left and right sides of the rear end of the holder member 50. The leg portions 91 are arranged in correspondence with base portions 50*b* of the support pillar portions 50*a* in the left-and-right direction. As illustrated in FIG. 9A, when the flushing box 88 is not in operation and held in a substantially vertical state, the leg portions 91 contact the base portions 50*b* from behind.

A pair of pin portions 93 project horizontally from the inner sides of a substantial middle portion of the holder member 50 in the direction defined by the height of the left and right support pillar portions 50*a*. The pin portions 93 are arranged in correspondence with the pin portions 92 of the leg portions 91 of the flushing box 88. A coil spring 94 is arranged between each of the pin portions 92 and the corresponding one of the pin portions 93. The urging force of the coil springs 94 constantly urges the flushing box 88 to pivot about the pivotal center defined by one end of the flushing box 88, or the pin portions 88*d* formed at the upper end of the flushing box 88, in the direction (a counterclockwise direction of FIGS. 9A to 11B) in which the leg portions 91 are pressed against the base portions 50*b* of the support pillar portions 50*a* of the holder member 50.

Referring to FIGS. 9A to 11B, a width increasing stepped portion (a posture change inducing portion) 95 is provided in an inner side of each support pillar portion 50*a* of the holder member 50 at a position downward from the upper end of the support pillar portion 50*a* by the distance corresponding to the depth of the flushing box 88. The width increasing stepped portion 95 makes the distance between the left and right support pillar portions 50*a* slightly increased compared to the width of the flushing box 88 in the left-and-right direction. This structure allows the flushing box 88 to pass between the left and right support pillar portions 50*a* of the holder member 50 at a position higher than the width increasing stepped portion 95. The flushing box 88 is thus allowed to move in the front-and-rear direction.

Therefore, when the movable members 43 and the wiper holder 80 move in the front-and-rear direction through rotation of the lead screws 31, 32, the flushing box 88 moves in the front-and-rear direction in association with the movement of the movable members 43 and the wiper holder 80. Specifically, when the movable members 43 move along the second threaded portions 34, 36 as the lead screws 31, 32 rotate, the two pin portions 88*d*, which are supported by the movable members 43 through the support pieces 90 of the wiper holder 80, move in association with the movable members 43. This moves the flushing box 88 between a receiving position (see FIG. 11B) at which the flushing box 88 is held in a horizontal posture and a non-receiving position (see FIG. 9A) spaced from the receiving position at which the flushing box 88 is held in a vertical posture. When located at the receiving position, the opening 88*a* is closely opposed to the nozzle-forming surface 21*a* of the recording head 21.

Figure 11A:
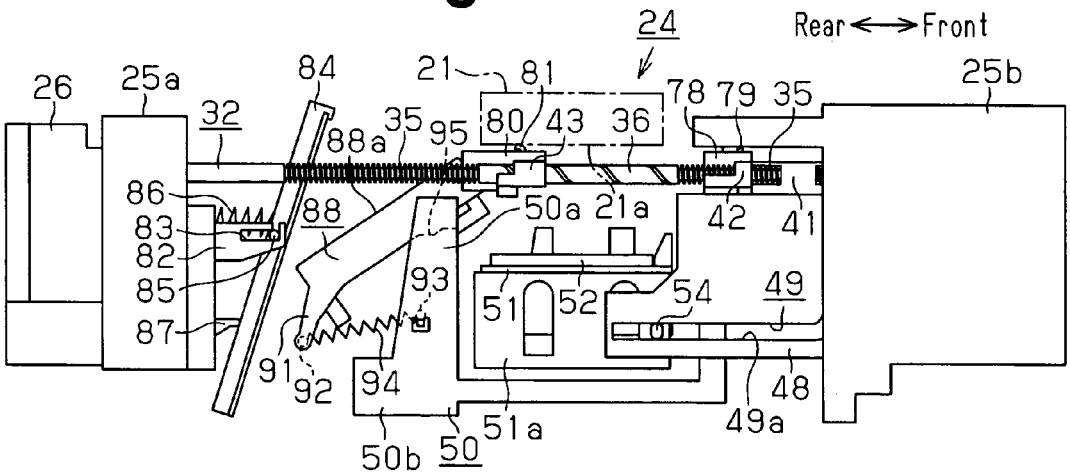
FIG. 11A is a view schematically showing a main portion of the maintenance unit when a single-row wiper member is located at a wiping position.
Figure 11B:
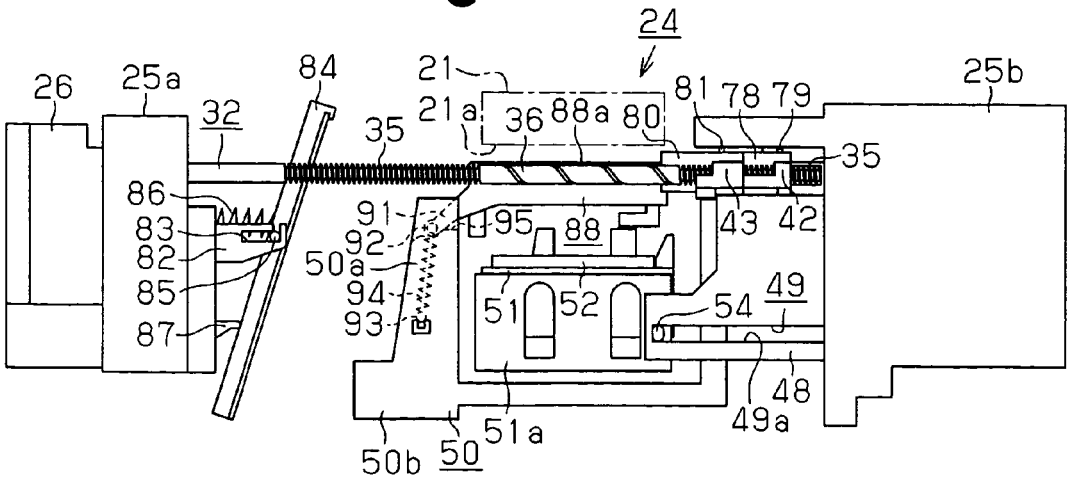
FIG. 11B is a view schematically showing a flushing box located at a liquid receiving position.

The coil springs 94 urge the flushing box 88 in the direction in which the flushing box 88 is switched to the vertical posture. When the movable members 43 move forward in this state, the posture of the flushing box 88 becomes inclined with the bottom surface of the flushing box 88 held in contact with the width increasing stepped portion 95, as illustrated in FIG. 11A. The flushing box 88 continuously proceeds together with the movable members 43 while gradually changing from the inclined posture to the horizontal posture. As the movable members 43 move further forward, the leg portions 91 of the flushing box 88 are brought into contact with the width increasing stepped portion 95. Eventually, as illustrated in FIG. 11B, the flushing box 88 is switched to the horizontal posture with the distal ends of the leg portions 91 supported by the width increasing stepped portion 95.

As has been described, as the movable members 43 advance, the flushing box 88 stably changes its posture from the vertical posture to the horizontal posture by allowing the bottom surface and the leg portions 91 of the flushing box 88 to contact the width increasing stepped portion 95. When the flushing box 88 is located at the receiving position, the distal ends of the leg portions 91 are held in contact with the width increasing stepped portion 95 by the urging force of the coil springs 94. This stably maintains the horizontal posture of the flushing box 88.

Contrastingly, as the movable members 43 move rearward, the flushing box 88 switches from the receiving position to the non-receiving position. As in the case of advancement of the movable members 43, while receiving the urging force of the coil springs 94, the flushing box 88 changes its posture stably from the horizontal posture to the vertical posture via the inclined posture in which the bottom surface and the leg portions 91 of the flushing box 88 are held in contact with the width increasing stepped portion 95. When the flushing box 88 is maintained at the non-receiving position, as illustrated in FIG. 9A, the urging force of the coil springs 94 and the urging force of the coil springs 86, which is applied to the flushing box 88 through the seal plate 84 in the direction opposite to the direction in which the urging force of the coil springs 94 acts, stably maintain the vertical posture of the flushing box 88.

Next, operation of the printer 10, which is configured as above-described, will be explained. The explanation focuses on, particularly, operation of the maintenance unit 24.

In the maintenance unit 24 of the illustrated embodiment, the plurality of driven members such as the cap member 51, the valve body 66, the wiper members 79, 81, and the flushing box 88 operate in different operational areas for different operational purposes. The flushing box 88 serves as a liquid receiver. In the following, operation for maintenance of each of these driven members will be described in turn.

First, operation of the cap member 51 will be explained.

Figure 9B:
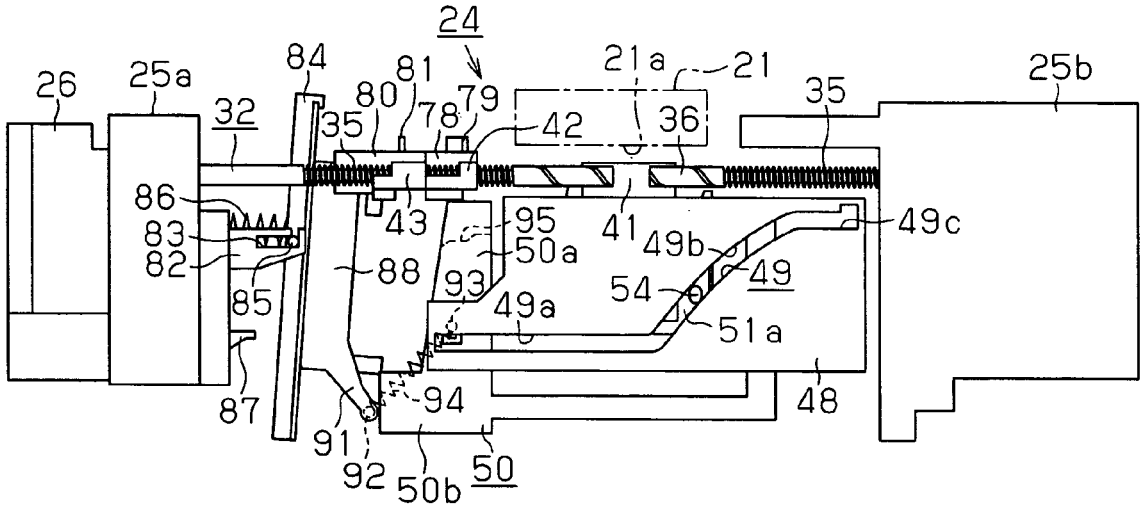
FIG. 9B is a view schematically showing the maintenance unit when the cap member is being raised or lowered.
Figure 9C:
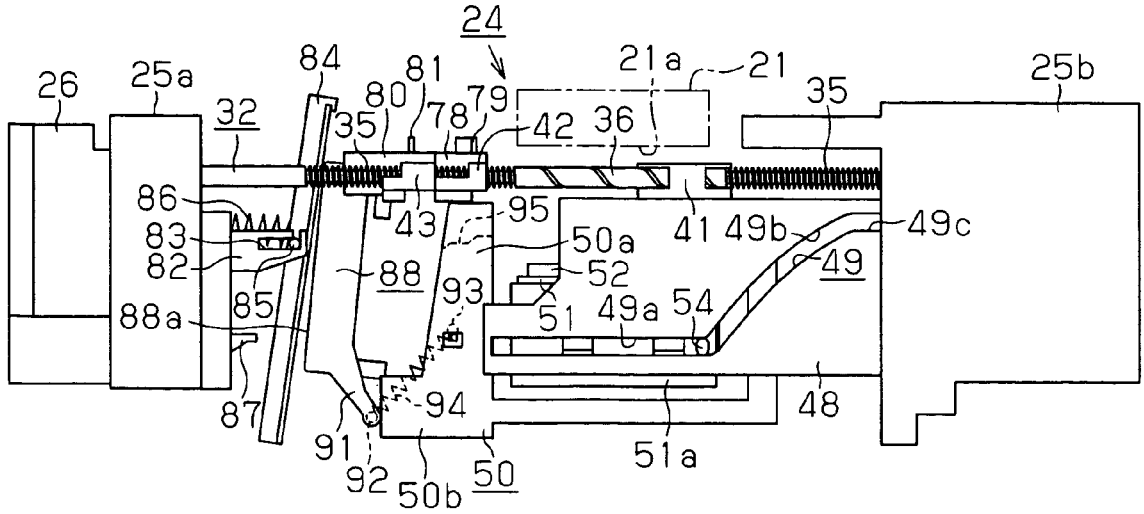
FIG. 9C is a view schematically showing the maintenance unit when the cap member is held at a non-sealing position.

When the printer 10 is printing on the paper sheet P, as illustrated in FIG. 9C, the maintenance unit 24 may perform cleaning, or draw and remove the ink from the nozzle openings 22 of the recording head 21 in order to, for example, prevent nozzle clogging. In this case, the printer 10 and the maintenance unit 24 operate in the following manners.

In printing, the carriage 16 reciprocates along the guide shaft 15 in a printing area. The carriage 16 is then returned from the position indicated by the single-dotted chain lines of FIG. 5 to the home position HP above the cap member 51 and then stopped. FIG. 5 corresponds to the state of the maintenance unit 24 of FIG. 9A. Afterwards, the drive motor 30 is driven to run in the reverse direction, thus rotating the lead screws 31, 32 in the reverse directions. This causes the movable members 41 to 43 to start retreating.

At this stage, or at the point of time corresponding to the state of FIG. 9C, the movable members 42, 43, the cylindrical portions 44 of which are engaged with the first threaded portions 33, 35 of the lead screws 31, 32, retreat relatively slowly. Contrastingly, the movable members 41, the cylindrical portions 44 of which are engaged with the second threaded portions 34, 36 of the lead screws 31, 32, retreat relatively quickly. In this state, the plates 48 that are formed integrally with the movable members 41 also retreat relatively rapidly.

Therefore, as illustrated in FIG. 9B, the projections 54 of the cap holder 51*a*, which are engaged with the guide bores 49 of the plates 48, are guided along the inclined portions 49*b* of the guide bores 49 and thus rise rapidly. As a result, as illustrated in FIG. 9A, the cap member 51 is sent to the uppermost position, or the sealing position. At this position, the cap member 51 seals the nozzle-forming surface 21*a* of the recording head 21 located at the home position HP through sealing performance of the seal portions 52.

The suction pump 29 is then activated by driving the pump motor 28, causing negative pressure in the cap small chambers of the cap member 51 and the ink drainage tubes 55. The ink is thus drawn from the nozzle openings 22 of the recording head 21 and then discharged into the waste ink tank that is arranged downstream from the suction pump 29, in a pressurized state.

As has been described, when the maintenance unit 24 performs cleaning, which is a type of maintenance operation, the lead screws 31, 32 are rotated by the drive force produced by the drive motor 30. The associated ones of the movable members 41, 42 and 43 thus move commonly along the axes S of the corresponding lead screws 31, 32. In this state, the movable members 41 moving along the second threaded portions 34, 36 selectively raise and lower the cap member 51, which is associated with the movable members 41 through the guide bores 49 and the projections 54, in association with the movement of the movable members 41.

In this regard, the cap member 51 is a driven member that is driven through the movable members 41 and operates in association with the movable members 41 while allowing transmission of the drive force from the lead screws 31, 32. When sending the cap member 51 from the sealing position (corresponding to the state of FIG. 9A) to the non-sealing position (corresponding to the state of FIG. 9C), the drive motor 30 is driven to run in the forward direction in the state of FIG. 9A. This rotates the lead screws 31, 32 in the forward directions, thus causing the movable members 41 and the plates 48 to proceed. The projections 54 of the cap holder 51*a* are thus guided to move downward by the inclined portions 49*b* of the guide bores 49. As a result, the cap member 51 is returned to the non-sealing position illustrated in FIG. 9C.

Next, operation of the air exposure valve device 58 will be described.

As has been described, to perform cleaning with the nozzle-forming surface 21*a* of the recording head 21 sealed by the cap member 51, the pressure in each cap small chambers of the cap member 51 and the pressure in each ink drainage tube 55 are forcibly lowered to a negative level. It is thus necessary to release the negative pressure from the cap small chambers and the ink drainage tubes 55 after cleaning is completed. For this purpose, the maintenance unit 24 operates in the following manner.

With the cap member 51 maintained at the sealing position (in the state of FIG. 9A) for sealing the nozzle-forming surface 21*a* of the recording head 21, the drive motor 30 is further rotated in the reverse direction, thus further rotating the lead screws 31, 32 in the reverse directions. This causes the movable members 41 to 43 to start further retreating.

When the maintenance unit 24 is held in the state of FIG. 9B, the pressing piece 56 is located at the position of FIGS. 12A and 12B, or at the right side of the maintenance unit 24. As the lead screws 31, 32 are rotated in the reverse directions further from this state, the movable members 41 to 43 are further retreated to the state of FIG. 9A. In this state, the pressing piece 56 is arranged immediately below the seat 75 of the air exposure valve device 58. Therefore, as the lead screws 31, 32 rotate in the reverse directions continuously from this state and the movable members 41 and the plates 48 further retreat, the pressing piece 56 that projects from the associated plate 48 also retreats continuously. Specifically, the plates 48 retreat continuously from the state of FIG. 9A to the state in which the projections 54 of the cap holder 51*a* are located in the vicinity of the front end of the front horizontal portions 49*c* of the guide bores 49. At this point, the pressing piece 56 contacts the suspended arm 74 of the lever member 70 of the air exposure valve device 58.

The lead screws 31, 32 rotate in the reverse directions further from this state and thus the plates 48 retreat continuously. This causes the pressing piece 56 to press the suspended arm 74 against the urging force of the coil spring 77, as illustrated in FIG. 13B, thus pivoting the suspended arm 74 in a counterclockwise direction. The horizontal arm 73 of the lever member 70 thus raises the valve body 66 through the engagement pieces 67 in such a manner that each of the valve body 66 separates from the valve seat 65 and rises to an air exposure position. This permits communication between the air exposure hole 63 and the air tube 64 and the air, thus releasing the negative pressure from each of the cap small chambers of the cap member 51 and each of the ink drainage tubes 55 through the air exposure hole 63 and the air tube 64.

As has been described, when the maintenance unit 24 performs air exposure operation which is a type of maintenance operation, the lead screws 31, 32 are rotated by the drive force produced by the drive motor 30, as in the case of cleaning. The associated ones of the movable members 41, 42 and 43 thus move commonly along the axes S of the corresponding lead screws 31, 32. In this state, the movable members 41, one of which is formed integrally with the plate 48 from which the pressing piece 56 projects, retreat relatively slowly along the front first threaded portions 33, 35. In such retreat, the movable members 41 raise the valve body 66 of the air exposure valve device 58.

In this regard, in addition to the aforementioned cap member 51, the valve body 66 of the air exposure valve device 58 is also driven member that is driven through the movable members 41 and operate in association with the movable members 41 while allowing transmission of the drive force from the lead screws 31, 32. To move the valve body 66 from the opening positions (corresponding to the state of FIG. 13B) to the closing positions (corresponding to the state of FIG. 13A), the drive motor 30 is driven to run in the forward direction in the state of FIG. 13B. This rotates the lead screws 31, 32 in the forward directions and causes the movable members 41 and the plates 48 to proceed. The pressing piece 56 is then separated from the suspended arm 74 of the lever member 70. As a result, the lever member 70 restores the state of FIG. 13A by the urging force of the coil spring 77. The horizontal arm 73 of the lever member 70 is thus spaced downward from the engagement pieces 67 of the valve body 66, returning the valve body 66 to the closing positions at which the valve body 66 is seated on the valve seats 65.

Operation of the wiper members 79, 81 will hereafter be explained.

In printing, the ink may adhere to the nozzle-forming surface 21*a* undesirably by, for example, being splashed back by the paper sheet P after drops of the ink have been ejected from the nozzle openings 22 onto the paper sheet P. Such adhesion of the ink may influence the direction in which the ink is ejected, leading to a printing problem. Thus, the ink must be wiped off or removed from the nozzle-forming surface 21*a*. For this purpose, the maintenance unit 24 operates in the following manner.

Specifically, with the maintenance unit 24 held in the state of FIG. 9C, the carriage 16 is moved from the position indicated by the single-dotted chain lines of FIG. 5 to the home position HP above the cap member 51 and then stopped. Subsequently, the drive motor 30 is driven to run in the forward direction, thus rotating the lead screws 31, 32 in the forward directions. This causes the movable members 41 to 43 to start proceeding.

At this stage, or at the point of time corresponding to the state of FIG. 9C, the movable members 41, the cylindrical portions 44 of which are engaged with the second threaded portions 34, 36 of the lead screws 31, 32, reach the front first threaded portions 33, 35 through continuous rotation of the lead screws 31, 32 in the forward directions and proceed along the first threaded portions 33, 35 relatively slowly. Meanwhile, the cylindrical portions 44 of the movable members 42, 43 are engaged with the rear first threaded portions 33, 35 of the lead screws 31, 32. The movable members 42, which are located forward from the movable members 43, reach the second threaded portions 34, 36 through continuous rotation of the lead screws 31, 32 in the forward directions and proceed along the second threaded portions 34, 35 relatively rapidly. In this state, the wiper holder 78, which connects the two movable members 42, also proceeds relatively rapidly.

Figure 10:
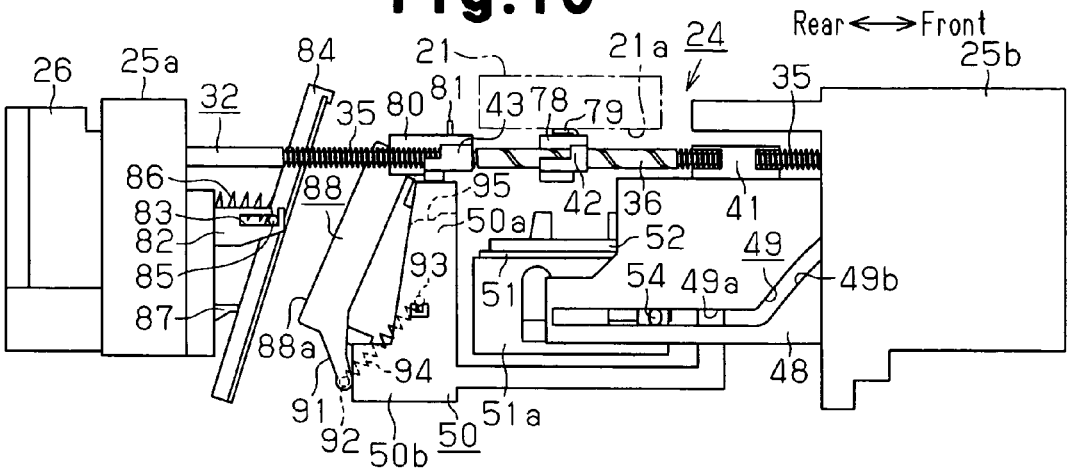
FIG. 10 is a view schematically showing the maintenance unit when an all-row wiper member is located at a wiping position.

This advances the wiper member 79, which is mounted on the upper surface of the wiper holder 78, from the non-wiping position of FIG. 9C to the wiping position of FIG. 10, together with the wiper holder 78. In proceeding, the wiper member 79 slidably contacts the nozzle-forming surface 21*a* of the recording head 21 held at the home position HP while elastically deforming its distal end or the upper end. Through such slidable contact with the nozzle-forming surface 21*a*, the wiper member 79 wipes off and removed the adhered ink from the nozzle-forming surface 21*a* throughout the entire nozzle-forming surface 21*a*.

The speed at which the movable members 42 move along the second threaded portions 34, 36 is set to a value suitable for wiping off the ink from the nozzle-forming surface 21*a* of the recording head 21 using the wiper member 79. For this purpose, the rotational speed of each lead screw 31, 32 is selected in correspondence with the number of the pitches of each second threaded portion 34, 36. Through rotation of the lead screws 31, 32 at this rotational speed, the aforementioned cap member 51 is selectively raised and lowered between the sealing position and the non-sealing position. At this stage, if the movement speed of the cap member 51 is excessively great, the cap member 51 may cause an impact on the recording head 21 when contacting the nozzle-forming surface 21*a* after having been raised. To avoid the impact, it is desirable to set the inclination of the inclined portion 49*b* to a value that allows the cap member 51 to move at a relatively moderate speed.

As has been described, when the maintenance unit 24 performs wiping which is a type of maintenance operation, the lead screws 31, 32 are rotated by the drive force produced by the drive motor 30, as in the cases of cleaning and air exposure. The associated ones of the movable members 41, 42 and 43 thus move commonly along the axes S of the corresponding lead screws 31, 32. In this state, the movable members 42 moving along the second threaded portions 34, 36 selectively advance or retract the wiper member 79, which is associated with the movable members 42 through the wiper holder 78, in association of the movable members 42.

In this regard, the wiper member 79 is a driven member that is driven through the movable members 42 and operates in association with the movable members 42 while allowing transmission of the drive force from the lead screws 31, 32. After the wiper member 79 has been sent from the non-wiping position (corresponding to the state of FIG. 9C) to the wiping position (corresponding to the state of FIG. 10), the nozzle-forming surface 21*a* is wiped. After such wiping, the drive motor 30 is rotated in the reverse direction to return the wiper member 79 to the original position, or the non-wiping position. This causes reverse rotation of the lead screws 31, 32 and thus retreating of the movable members 42 and the wiper holder 78. As a result, the wiper member 79 is returned to the original position, or the non-wiping position illustrated in FIG. 9C, together with the movable members 42 and the wiper holder 78. When the movable members 42 and the wiper holder 78 retreat, it is desirable to arrange the recording head 21, together with the carriage 16, at a position outside the home position HP so as to prevent unnecessary wiping of the nozzle-forming surface 21*a* of the recording head 21 by the wiper member 79.

Depending on, for example, the frequency of ink ejection, the zones defining the nozzle rows may be cleaned one by one instead of wiping off the adhered ink from the entire nozzle-forming surface 21*a*. In this case, the single-row wiper member 81, which operates in association with the movable members 43 through the wiper holder 80, is operated instead of the all-row wiper member 79.

Specifically, the lead screws 31, 32 are caused to rotate in the forward directions before the carriage 16 is sent to the home position HP. Further, the all-row wiper member 79 is moved from the position of FIG. 9C to the position of FIG. 11A via the position of FIG. 10.

At this stage, the carriage 16 is returned to and stopped at the home position HP. At this stage, the position of the carriage 16 is adjusted in such a manner that one of the nozzle row defining zones, which is the target of wiping, is located in correspondence with the movement path of the wiper member 81 in the front-and-rear direction. Afterwards, the lead screws 31, 32 are rotated again in the forward directions. This causes the movable members 43 and the wiper holder 80 to retreat from the positions of FIG. 11 passing below the nozzle-forming surface 21*a* of the recording head 21 held at the home position HP. In this manner, the single-row wiper member 81 wipes solely a portion of the nozzle-forming surface 21*a*.

As has been described, when the maintenance unit 24 performs wiping, which is a type of maintenance operation, the all-row wiper member 79 and the single-row wiper member 81 are selectively operated depending on whether the wiping should be carried out on the entire portion or a restricted portion of the nozzle-forming surface 21*a*. In either case, the lead screws 31, 32 are actuated by the drive force of the drive motor 30, as in the cases of the cleaning and the air exposure operation. Specifically, the associated ones of the movable members 41, 42 and 43 move along the axes S of the corresponding lead screws 31, 32. To wipe the restricted portion of the nozzle-forming surface 21*a*, the movable members 43 moving along the second threaded portions 34, 36 selectively advance and retract the wiper member 81, which is associated with the movable members 43 through the wiper holder 80, in association with the movement of the movable members 43.

In this regard, the wiper member 81 is a driven member that is driven through the movable members 43 and operates in association with the movable members 43 while allowing transmission of the drive force from the lead screws 31, 32. After the wiper member 81 is moved from the non-wiping position to the wiping position and caused to wipe the nozzle-forming surface 21*a*, the wiper member 81 is returned to the original position, or the non-wiping position. In this case, the recording head 21 is moved to a position spaced from the home position HP to prevent contact between the wiper member 81 and the nozzle-forming surface 21*a* of the recording head 21. The drive motor 30 is then driven to rotate in the reverse direction. This causes reverse rotation of the lead screws 31, 32 and thus retreating of the movable members 43 and the wiper holder 80. As a result, the wiper member 81 is returned to the original position, or the non-sealing position illustrated in FIG. 9C, together with the movable members 43 and the wiper holder 80. Afterwards, the recording head 21 is rearranged at the home position HP in such a manner that an area of the nozzle-forming surface 21*a* different from the portion of the nozzle-forming surface 21*a* that has been wiped is located in correspondence with the movement path of the wiper member 81. The movable members 43 are then moved forward to wipe the corresponding portion of the nozzle-forming surface 21*a*.

Finally, operation of the flushing box 88 will be described as follows.

After the above-described wiping of the nozzle-forming surface 21*a* of the recording head 21 by the wiper member 81 is completed, as illustrated in FIG. 11B, flushing is performed for stabilizing the meniscuses of the ink in the nozzle openings 22. Specifically, in association with the movable members 43 that move forward, the flushing box 88 moves forward from the position of FIG. 9C to the position of FIG. 11B while changing the posture of the flushing box 88. Piezoelectric elements (not shown) are arranged in the recording head 21 in correspondence with the nozzle openings 22. The flushing refers to ejection of the ink from the nozzle openings 22 through excitement of the piezoelectric elements in response to a control signal unrelated to printing.

While switching from the state of FIG. 9C to the state of FIG. 11B, the position of the flushing box 88 changes in the following manner. Before the movable members 43 start proceeding, the flushing box 88 is held in a substantially vertical state, as illustrated in FIG. 9C. As the lead screws 31, 32 rotate in the forward directions, the movable members 43 gradually advance along the rear first threaded portions 33, 35. In such advancing of the movable members 43, the flushing box 88 pivots about the pin portions 88*d*, which are located at one end, or the upper end, of the flushing box 88, in a clockwise direction of FIGS. 9A to 10. In other words, the flushing box 88 changes its position while moving in the front-and-rear direction that is perpendicular to the reciprocating direction of the carriage 16, or the left-and-right direction.

More specifically, at a first stage, the legs 91 are held in contact with the base portions 50*b* of the support pillar portions 50*a* of the holder member 50 by the urging force of the coil spring 94. However, as the movable members 43 continuously proceed from the positions of FIG. 10, the bottom surface of the flushing box 88 is mounted on the width increasing stepped portions 95 of the support pillar portions 50*a*. Then the lead screws 31, 32 are further rotated in a forward direction in such a manner that the movable members 43 reach the second threaded portions 34, 36, as illustrated in FIG. 11B.

From this point of time, the movable members 43 advances at increased speed to the front first threaded portions 33, 35. In this state, the flushing box 88 is deployed at the receiving position that is immediately below the home position HP while maintaining a horizontal position with the leg portions 91 supported by the width increasing stepped portion 95 of the support pillar portions 50*a*. At this stage, the carriage 16 is sent to and stopped at the home position HP that is immediately above the flushing box 88. The opening 88*a* of the flushing box 88 thus becomes opposed and close to the nozzle-forming surface 21*a* of the recording head 21.

As soon as the wiping of the nozzle-forming surface 21*a* by the wiper member 81 is completed in the above-described manner, the flushing box 88 is deployed at the receiving position at which the flushing box 88 is held in the horizontal posture. In this state, the recording head 21 is subjected to the flushing by ejecting the ink from the nozzle openings 22. Afterwards, if an instruction for printing has been already generated, the recording head 21 is moved to the printing area integrally with the carriage 16. Printing is then performed on the paper sheet P.

The flushing may be conducted by the maintenance unit 24 before the recording head 21 starts to print on the paper sheet P with the nozzle-forming surface 21*a* of the recording head 21 sealed by the cap member 51, as illustrated in FIG. 9A. That is, the flushing must be performed, for example, after the printer 10 has been maintained in a turned-off state without being operated for several days and the ink in the nozzle openings 22 has been dried. In the flushing before printing, the printer 10 and the maintenance unit 24 operate in the following manners.

Specifically, in the state of FIG. 9A, the carriage motor 19 is driven to move the recording head 21 to the position outside the home position HP integrally with the carriage 16. The drive motor 30 is then rotated in the forward direction and thus the lead screws 31, 32 are rotated in the forward directions. This moves the cap member 51 and the wiper member 79 in association with the corresponding movable members 41, 42 advancing to the positions corresponding to the state of FIG. 11A. In this state, the drive motor 30 is rotated continuously in the forward direction so as to rotate the lead screws 31, 32 further in the forward directions.

Then, through continuous rotation of the lead screws 31, 32 in the forward directions, the movable members 43 and the wiper holder 80 proceed from the state of FIG. 11A, passing below the home position HP. The movable members 43 then reach the front first threaded portions 33, 35, as illustrated in FIG. 11B. In this case, the single-row wiper member 81, which is secured to the upper surface of the wiper holder 80, also proceeds passing below the home position HP, integrally with the movable members 43. However, since the carriage 16 is not yet deployed at the home position HP at this stage, unnecessary wiping of the nozzle-forming surface 21*a* does not occur.

In this state, the flushing box 88 is deployed at the receiving position that is immediately below the home position HP while maintaining a horizontal position with the leg portions 91 supported by the width increasing stepped portion 95 of the support pillar portions 50*a*. At this stage, the carriage 16 is sent to and stopped at the home position HP that is immediately above the flushing box 88. The opening 88*a* of the flushing box 88 thus becomes opposed and close to the nozzle-forming surface 21*a* of the recording head 21. Then, the ink is ejected from the nozzle openings 22 of the recording head 21 for the flushing. The ink is thus absorbed and retained by the liquid absorber 88*b* in the flushing box 88.

As has been described, when the maintenance unit 24 performs flushing, which is a type of maintenance operation, by the maintenance unit 24, the lead screws 31, 32 are actuated by the drive force of the drive motor 30, as in the cases of the cleaning, the air exposure, and the wiping. The associated ones of the movable members 41, 42 and 43 thus move along the axes S of the corresponding lead screws 31, 32. The movable members 43 advance or retract the flushing box 88 or change the position of the flushing box 88, which is associated with the movable members 43 through the wiper holder 80, in association with the movement of the movable members 43.

In this regard, in addition to the above-described wiper member 81, the flushing box 88 is a driven member that is driven through the movable members 43 and operates in association with the movable members 43 while allowing transmission of the drive force from the lead screws 31, 32. To return the flushing box 88 from the receiving position (corresponding to the state of FIG. 11B) to the non-receiving position (corresponding to the state of FIGS. 9A to 9C) after the flushing, the drive motor 30 is rotated in the reverse direction in the state of FIG. 11B. This causes reverse rotation of the lead screws 31, 32 and thus retreat of the movable members 43 and the wiper holder 80. The urging force of the coil springs 94 thus urge the flushing box 88 to pivot in the direction in which the leg portions 91 are brought into contact with the base portions 50*b* of the support pillar portions 50*a*. As a result, the flushing box 88 is returned to the non-receiving position as illustrated in FIG. 9C.

Before the printer 10 is turned off, the lead screws 31, 32 are further rotated in the reverse directions in such a manner that the movable members 43 retreat to the positions of FIG. 9A. This causes the flushing box 88 to pivot about the pin portions 88*d* and restore a vertical position. The opening 88*a* of the flushing box 88 is thus blocked by the seal plate 84. In this state, the coil springs 86 urge the seal plate 84 toward the flushing box 88, ensuring sealing performance of the opening 88*a* of the flushing box 88.

Figure 15:
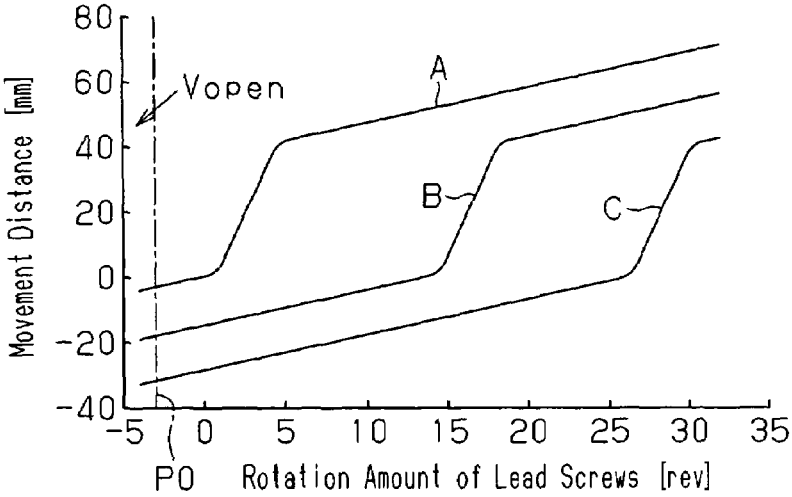
FIG. 15 is a graph representing the relationship between the rotation amount of the lead screw and the movement distances of the movable members.

FIG. 15 is a graph representing variation of the movement distance of the movable members 41 to 43 in correspondence with the rotational amount (rev) of the lead screws 31, 32. In the graph, the solid line A represents the movement distance of each movable member 41. The solid line B represents the movement distance of each movable member 42. The solid line C represents the movement distance of each movable member 43. As is understood from FIG. 15, although the associated ones of the movable members 41, 42 and 43 are mounted on the same lead screws 31, 32 and move in the direction of the axes S of the lead screws 31, 32, the movable members 41 to 43 are moved to different positions in the direction of the axes S of the lead screws 31, 32 in correspondence with the rotation amount of the lead screws 31, 32.

The solid lines A, B, C representing the movement distances of the movable members 41 to 43 each exhibit a steep rise, indicating that the corresponding movable members 41 to 43 moving along the second threaded portion 34, 36 of the lead screws 31, 32. In the graph, the rotation amount of the lead screws 31, 32 indicated by the single-dotted chain line P0 corresponds to the base position of the lead screws 31, 32. A controller, or a CPU (not shown), controls the operational state of the drive motor 30 with reference to the rotation amount (the rotational angle) indicated by the single-dotted chain line P0. If the rotation amount of the lead screws 31, 32 falls in the range Vopen, which is illustrated at the left side of the single-dotted chain line P0 of FIG. 15, it is indicated that the cap member 51 is located at the sealing position at which the cap member 51 seals the nozzle-forming surface 21*a* of the recording head 21. Meanwhile, the pressing piece 56 of the movable member 41 presses the lever member 70 of the air exposure valve device 58 so as to raise the valve body 66 to the opening positions.

The illustrated embodiment has the following advantages.

(1) The flushing box 88 moves between the receiving position and the non-receiving position spaced from the receiving position. The receiving position is located immediately below and opposed to the nozzle-forming surface 21*a* of the recording head 21 that is held at the home position HP. It is thus unnecessary to arrange the flushing box 88 in an area opposed to the home position HP with respect to the printing area of the paper sheet P. This eliminates the necessity of ensuring arrangement space exclusively for the flushing box 88 in the body casing 11 of the printer 10. The body casing 11 thus becomes smaller in size.

(2) When the ink is ejected from the nozzle openings 22 of the recording head 21 as waste ink, the flushing box 88 is located in such a manner as to receive the waste ink. The waste ink is thus prevented from receiving resistance of the air and transforming into mist that floats in the body casing 11. This suppresses contamination of the interior of the printer 10 by the floating mist of the waste ink.

(3) The sealing position of the cap member 51 is located immediately below the nozzle-forming surface 21*a*. The receiving position of the flushing box 88 is located in correspondence with the sealing position, or, in other words, at a position close to and overlapping with the sealing position of the cap member 51 in the up-and-down direction. That is, the receiving position of the flushing box 88 in flushing is located at a position close to the nozzle-forming surface 21*a* of the recording head 21 like the sealing position of the cap member 51. This suppresses enlargement of the size of the printer 10 as a whole in the up-and-down direction. Further, the flushing can be performed immediately after cleaning is completed and the cap member 51 is returned from the sealing position to the non-sealing position.

(4) The receiving position of the flushing box 88 is set in correspondence with the wiping position of each wiper member 79, 81, at which the wiper member 79, 81 slides on the nozzle-forming surface 21*a* of the recording head 21. In other words, the receiving position of the flushing box 88 is located at a position close to and overlapping with the wiping position in the up-and-down direction. That is, the receiving position of the flushing box 88 in flushing is set at a position close to the nozzle-forming surface 21*a* of the recording head 21 like the wiping position of each wiper member 79, 81. This suppresses enlargement of the size of the printer 10 as a whole in the up-and-down direction. Further, the flushing can be carried out immediately after wiping is completed and the wiper member 79, 81 is returned from the wiping position to the non-wiping position.

(5) The direction in which the flushing box 88 moves in association with the movable members 43 is the front-and-rear direction, which is the direction perpendicular to the reciprocating direction of the carriage 16. It is thus unnecessary to ensure space for movement of the flushing box 88 in the reciprocating direction of the carriage 16. This prevents the lateral dimension of the body casing 11 from increasing, suppressing enlargement of the size of the printer 10.

(6) When located at the non-receiving position of FIGS. 9A to 9C, the flushing box 88 is held by the wiper holder 80 while maintained in the vertical, or substantially vertical, posture with the opening 88*a* extending laterally, or substantially laterally. Therefore, the space occupied by the flushing box 88 at the non-receiving position becomes relatively small as viewed from above. This also reduces the size of the printer 10.

(7) When the flushing box 88 moves between the receiving position and the non-receiving position, the bottom surface and the leg portions 91 of the flushing box 88 contact the width increasing stepped portion 95 of the pillar portions 50*a* of the holder member 50. Such contact allows the flushing box 88 to pivot, changing the posture of the flushing box 88 between a horizontal state and a vertical state. In this manner, the posture of the flushing box 88 is easily and smoothly switched from the state corresponding to an original position (the receiving position or the non-receiving position) to the state corresponding to a target position (the non-receiving position or the receiving position).

(8) The liquid absorber 88*b* is received in the flushing box 88, which is shaped like a box with a closed bottom. The waste ink that has been received by the flushing box 88 through the opening 88*a* is thus absorbed by the liquid absorber 88*b*. Therefore, even when the flushing box 88 moves, the waste ink is retained by the liquid absorber 88*b*. This suppresses contamination of the interior of the body casing 11.

(9) The waste ink is drawn from the flushing box 88 through actuation of the suction pump 29 and discharged through the waste liquid tube 89. The reception performance of the waste ink by the flushing box 88 is thus maintained at a desirable level.

(10) The drive mechanism for moving the flushing box 88, or the liquid receiver movement mechanism, includes the lead screws 31, 32 and the movable members 43 that move forward or rearward in the directions of the axes S of the corresponding lead screws 31, 32. Accordingly, the flushing box 88 is moved easily through simple operation, or by rotating the lead screws 31, 32.

(11) When the movable members 43 move along the second threaded portions 34, 36 through rotation of the lead screws 31, 32, the flushing box 88 is moved in association with the movable members 43. The flushing box 88 is thus allowed to move quickly while changing its posture.

The illustrated embodiment may be modified as follows.

Figure 16A:
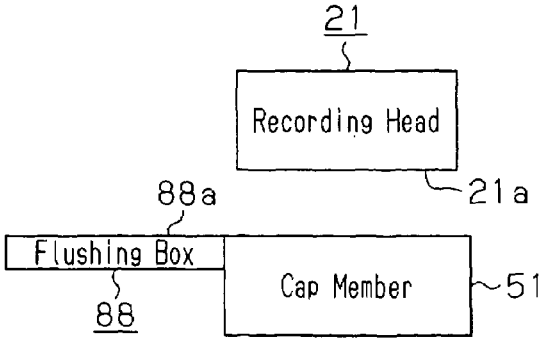
FIG. 16A is a view for explaining the position of a flushing box of a modified embodiment when cleaning is performed on a recording head.
Figure 16B:
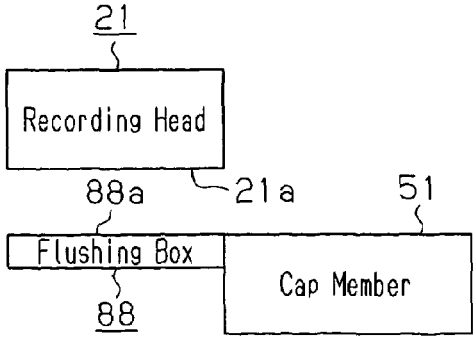
FIG. 16B is a view for explaining the position of the flushing box of the modified embodiment when flushing is performed on the recording head.

As schematically shown in FIG. 16, the flushing box 88 may be supported by the cap member 51. The flushing box 88 is moved in association with the cap member 51. In this case, when the lead screws 31, 32 rotate, the cap member 51 selectively advances and retreats between the sealing position immediately below the nozzle-forming surface 21*a* of the recording head 21 and the non-sealing position spaced from the sealing position in the front-and-rear direction (the direction of the axis S of each lead screw). When cleaning is performed on the recording head 21 as illustrated in FIG. 16A, the cap member 51 is located at the sealing position. In this state, the flushing box 88, which is supported by the rear end of the cap member 51, is located at a non-receiving position. In flushing, as illustrated in FIG. 16B, the cap member 51 may be moved forward to the non-sealing position and the flushing box 88 is deployed at a receiving position closely opposed to the nozzle-forming surface 21*a* of the recording head 21. In this modified embodiment, the cap member 51 functions as a movable member that moves throughout the range between a receiving position and a non-receiving position through operation of the lead screws 31, 32, which are drive force transmitting members.

The flushing box 88 may move between a non-receiving position and a receiving position in association with the wiper holder 80, which supports the wiper member 81. In such movement, the flushing box 88 may maintain a horizontal posture without changing its posture. In this modified embodiment, the wiper member 81 functions as a movable member that moves throughout the range between a receiving position and a non-receiving position through operation of the lead screws 31, 32, which are drive force transmitting members.

The receiving position of the flushing box 88 may be set to a position corresponding to and overlapping with at least one of the sealing position of the cap member 51 and the wiping position of the wiper member 81 in the up-and-down direction.

The flushing box 88 may operate in association with the movable members 41, 42, other than the movable members 43. The flushing box 88 thus moves in association with the movable members 41, 42.

The lead screw 31, 32 may be located at the right end of the body casing 11 and extend in the left-and-right direction. In this case, as the lead screws 31, 32 rotate, the flushing box 88 move in the reciprocating direction of the carriage 16 (the left-and-right direction).

The drive force transmitting members, which are formed by the lead screws 31, 32, may be slidable members or shafts that slide along the direction of the axes S. In this case, at least one movable member is secured to each of the shafts at a predetermined interval in the longitudinal direction of the shaft. A plurality of driven members are operated when the movable members are moved through movement of the shafts and operate in association with the driven members.

The threaded groove 47 of the lead screw 31 and that of the lead screw 32 may be spiral grooves with the same pitch.

Each movable member may include a nut member in which a female threaded bore to engage with the corresponding lead screws 31, 32 is provided. In this case, the female threaded bore is an engagement portion.

The posture change inducing portion may be formed in such a manner that the height and the shape of the upper end surface of each pillar portion 50*a* of the holder member 50 correspond to the height and the shape of the width increasing stepped portion 95.

The posture change inducing portion may be formed by a guide plate having, for example, an arcuate guide groove with which the pin portions 92 of the flushing box 88 are engaged.

The waste liquid tube 89 does not necessarily have to be connected to the flushing box 88.

When located at the non-receiving position, the flushing box 88 may be held by the wiper holder 80 in a posture transitive between the vertical posture and the horizontal posture or the horizontal posture.

The flushing box 88 may be associated with a specific lead screw that is provided separately from the lead screws 31, 32 and extends in the movement direction of the carriage 16 through a movable member. In this case, an additional drive source other than the carriage motor 19 is preferably provided for driving the specific lead screw.

Figure 17:
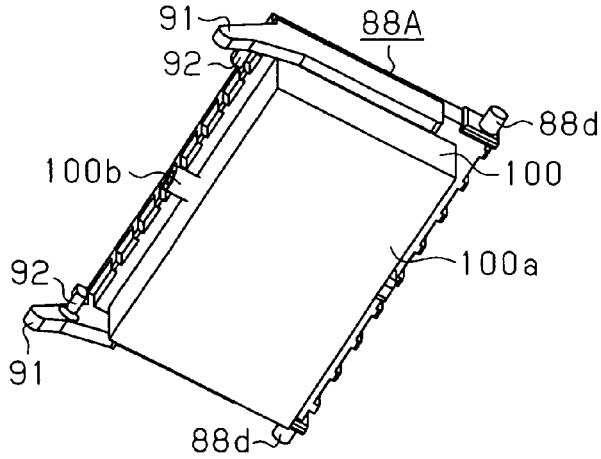
FIG. 17 is a perspective view showing a flushing box of a modified embodiment as viewed from below.

In the illustrated embodiment, the maintenance unit 24 may include a flushing box 88A shown in FIG. 17 as a liquid receiver. Further, a plate 48, which is shown in FIGS. 18A and 18B, may be formed integrally with the movable members 41, which form the drive force transmission device.

A lid portion 100 is arranged on a lower surface of the flushing box 88A of this modified embodiment. The lid portion 100 has a rectangular box-like shape corresponding to the shape of the cap member 51 as viewed from above. The flushing box 88A and the lid portion 100 are formed of synthetic resin and as an integral body. A lower surface 100*a* of the lid portion 100 is finished as a smooth flat surface. A connection port 100*b* projects from a side surface of the lid portion 100. The waste liquid tube 89, which communicates with the waste ink tank, is connected to the connection port 100*b*.

In the plate 48A of this modified embodiment, a portion of a guide bore 49 by which the projection 54 of the cap holder 51*a* is slidably guided is different from the corresponding portion of the plate 48 of the illustrated embodiment. Specifically, as shown in FIGS. 18A and 18B, the rear end of the rear horizontal portion 49*a* of the guide bore 49 of the plate 48A does not reach a lower portion of the rear end of the plate 48A. An inclined portion 49*d* is formed continuously from the rear end of the rear horizontal portion 49*a* and extends diagonally toward an upper portion of the rear end of the plate 48A.

Figure 18A:
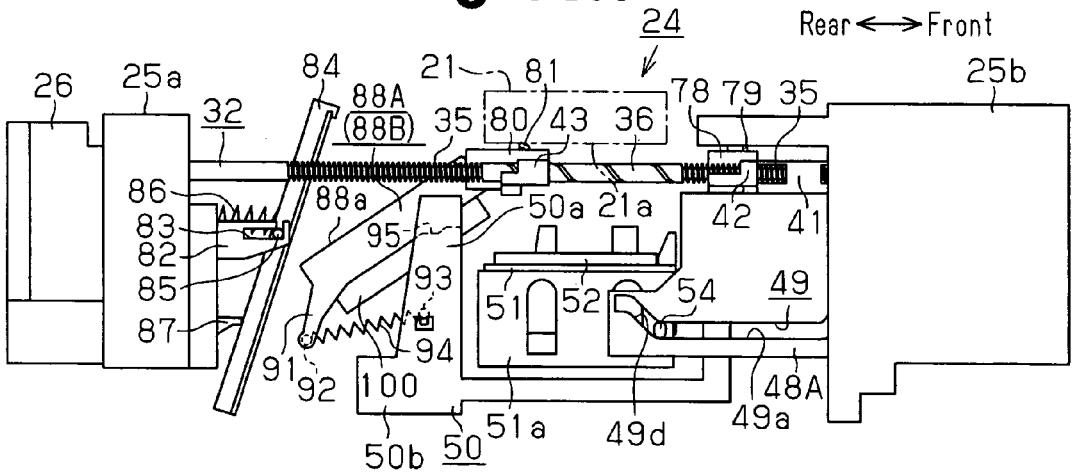
FIG. 18A is a schematic view showing a case in which a single-row wiper is arranged at a wiping position.
Figure 18B:
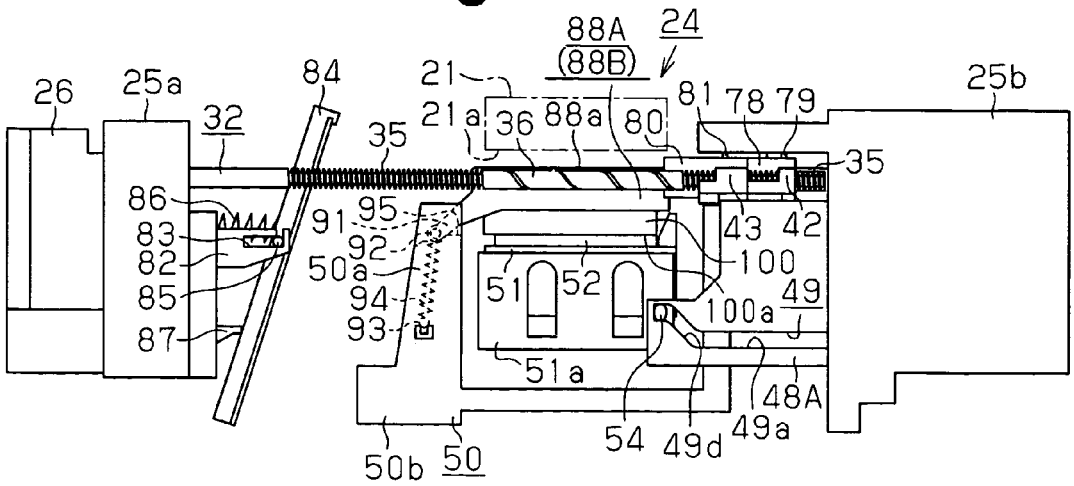
FIG. 18B is a schematic view showing a case in which the flushing box is located at a liquid receiving position.

Therefore, when the lead screws 31, 32 rotate further in the forward directions from the state of FIG. 18A, the projection 54 of the cap holder 51*a* engaged with the guide bore 49 of the plate 48A rapidly moves upward while guided by the inclined portion 49*d* of the guide bore 49, as illustrated in FIG. 18B. This raises the cap member 51 by a distance corresponding to the distance covered by movement of the projection 54, referring to FIG. 18B. The seal portion 52 of the cap member 51 thus contacts the lower surface 100*a* of the lid portion 100 of the flushing box 88, which is held in the horizontal posture at this stage.

In other words, after having been sent to the receiving position by the liquid receiver movement mechanism formed by the lead screws 31, 32 and the movable members 43, the flushing box 88A lids the cap member 51, which is held at the non-sealing position immediately below the sealing position, from above. The seal portion 52 of the cap member 51 contacts the lower surface 100*a* of the lid portion 100 of the flushing box 88A. This seals the interior of the cap member 51, or, more specifically, the interiors of the small cap chambers that are defined in the seal portion 52 and accommodate the ink absorbers 53. Since the lower surface 100*a* of the lid portion 100 of the flushing box 88A is a smooth flat surface, desirable seal performance of the lower surface 100*a* is ensured when held in contact with the seal portion 52 of the cap member 51.

Accordingly, in this modified embodiment, even if the cap member 51 is held at the non-sealing position for a prolonged time in printing, the cap member 51 is maintained in a state lidded by the lid portion 100 of the flushing box 88A. The small cap chambers are thus held in sealed states, thus suppressing dryness of the interior of the cap member 51. More specifically, dryness and resulting solidification of the ink retained by the ink absorbers 53 in the small cap chambers are suppressed.

Figure 19:
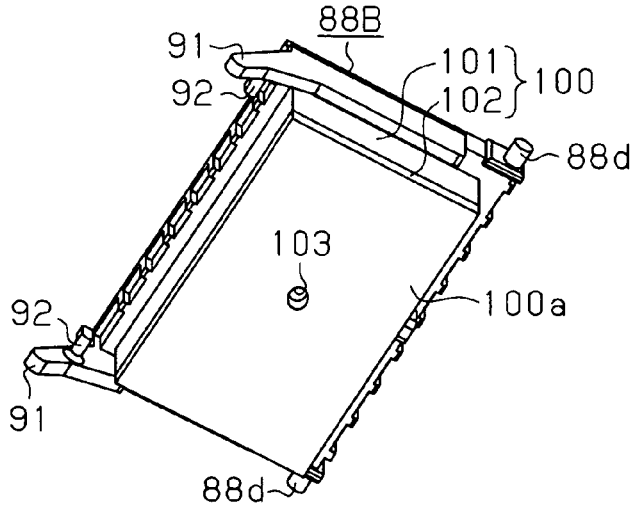
FIG. 19 is a perspective view showing a flushing box of another modified embodiment as viewed from below.
Figure 20:
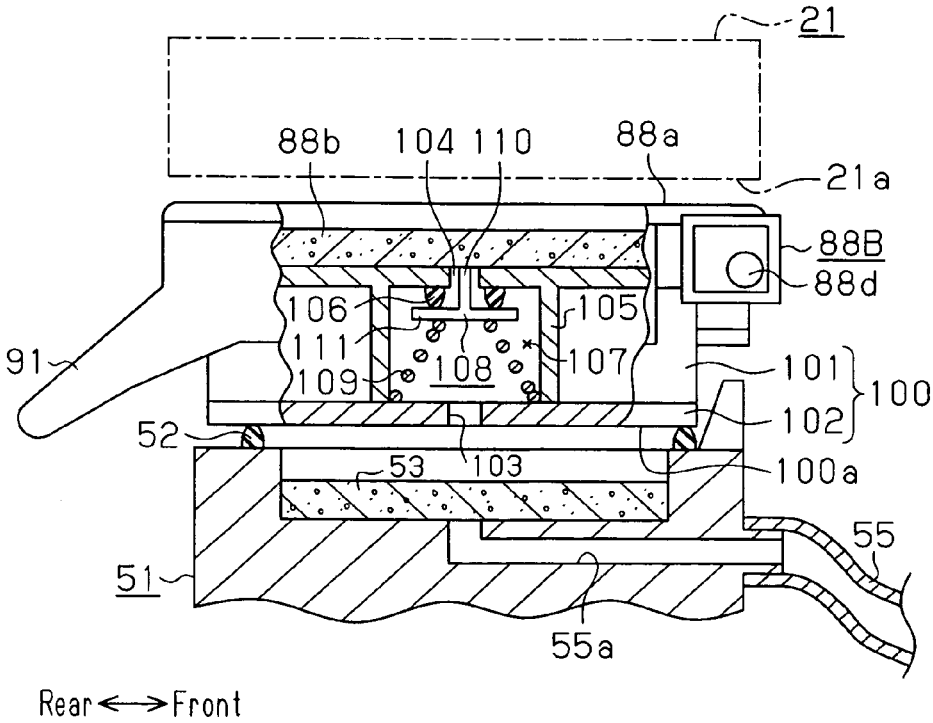
FIG. 20 is a partially exploded cross-sectional view showing a cap member lidded by the flushing box of the embodiment of FIG. 19.

The maintenance unit 24 may include a flushing box 88B shown in FIGS. 19 and 20. Further, the plate 48A, which is shown in FIGS. 18A and 18B, may be formed integrally with the movable members 41, which form the drive force transmission device.

Specifically, the flushing box 88B of this modified embodiment also has a lid portion 100, which is formed on a lower surface of the flushing box 88B. The lid portion 100 has a rectangular box-like shape corresponding to the shape of the cap member 51 as viewed from above. In this regard, the flushing box 88B is similar to the flushing box 88A of the above-described modified embodiment of FIG. 17. However, the lid portion 100 of the flushing box 88B of FIG. 19 has a continuous wall portion 101 having a rectangular shape and a lid plate 102 shaped like a rectangular flat plate. The continuous wall portion 101 is formed integrally with the circumference of the lower surface of the flushing box 88B. The lid plate 102 closes a distal opening defined by the continuous wall portion 101. A through hole 103 is defined substantially in the center of the lid plate 102. A lower surface 100*a* of the lid portion 100, which is formed by the lower surface of the lid plate 102, is finished as a smooth flat surface.

Further, as shown in FIG. 20, a valve bore 104 is defined substantially in the center of the bottom of the flushing box 88B of this modified embodiment. A cylindrical wall 105 projects from the lower surface of the flushing box 88B and is arranged about the valve bore 104. The height of the cylindrical wall 105 is equal to the height of the continuous wall portion 101. A seal member 106 is arranged on the lower surface of the flushing box 88B and fixedly bonded with the circumference of the valve bore 104. Since the distal opening defined by the continuous wall portion 101 is blocked by the lid plate 102, a valve accommodation chamber 107 is provided inside the cylindrical wall 105. The valve accommodation chamber 107 accommodates a valve body 108 and a coil spring 109.

The valve body 108 has a valve shaft 110, which is loosely received in the valve bore 104. A flange-like spring receiving portion 111 is provided at the proximal end (the lower end as viewed in FIG. 20) of the valve shaft 110. The valve shaft 110 and the spring receiving portion 111 are formed integrally with each other. The coil spring 109 is arranged between the spring receiving portion 111 and the lid plate 102. The urging force of the coil spring 109 urges the valve body 108 toward a closing position at which the spring receiving portion 111 is held in tight contact with the seal member 106. When the spring receiving portion 111 is moved to an opening position at which the spring receiving portion 111 is spaced from the seal member 106 against the urging force of the coil spring 109, the interior of the flushing box 88B is allowed to communicate with the exterior through the through hole 103 extending through the lid plate 102.

With reference to FIG. 18B, when the flushing box 88B is switched to a receiving position and the lid portion 100 lids the cap member 51 from above, the seal portion 52 of the cap member 51 contacts the lower surface 100*a* of the lid portion 100 as illustrated in FIG. 20. As a result, as in the case of the flushing box 88A of FIG. 17, the interior of the cap member 51, or, more specifically, the interior of each of the small cap chambers defined in the seal portion 52 for accommodating the ink absorbers 53, is sealed by the lid portion 100. Since the lower surface 100*a* of the lid portion 100 of the flushing box 88B, or the lower surface of the lid plate 102, is finished smooth and flat, desirable seal performance of the lower surface 100*a* is ensured when held in contact with the seal portion 52 of the cap member 51.

Accordingly, also in this modified embodiment, even if the cap member 51 is held at the non-sealing position for a prolonged time in printing, the cap member 51 is maintained in a state lidded by the lid portion 100 of the flushing box 88B. The small cap chambers are thus held in sealed states, suppressing dryness of the interior of the cap member 51. More specifically, dryness and resulting solidification of the ink retained by the ink absorbers 53 in the small cap chambers are suppressed.

Further, in this embodiment, when the suction pump 29 is actuated in the state of FIG. 20, negative pressure is generated in each of the small cap chambers of the cap member 51. This also causes negative pressure in the valve accommodation chamber 107 of the flushing box 88B, which communicates with the interior of the cap member 51 through the through hole 103. The negative pressure urges the spring receiving portion 111 of the valve body 108 to separate from the seal member 106, or toward the opening position, against the urging force of the coil spring 109. The interior of the flushing box 88B is thus exposed to intense suction force applied through the valve bore 104.

As a result, the waste ink retained by the liquid absorbers 88*b* in the flushing box 88B flows through the valve bore 104, the valve accommodation chamber 107, and the through hole 103 and thus drawn into the cap member 51. Accordingly, together with the waste ink retained by the ink absorbers 53 of the cap member 51, the waste ink is drained into the waste ink tank through an ink drainage line 55*a* and the ink drainage tubes 55, which form a liquid passage.

As has been described, the flushing box 88B of this modification permits, when necessary, drainage of the waste ink retained by the liquid absorber 88*b* of the flushing box 88B through the cap member 51 through actuation of the suction pump 29. Therefore, compared to the flushing box 88A of FIG. 17, the flushing box 88B is further advantageous in that the liquid (ink) receiving performance of the flushing box 88B is maintained at a desirable level for a prolonged time.

The printer 10 may be an off-carriage type inkjet printer, other than the on-carriage type inkjet printer in which the ink cartridge 23 is mounted in the carriage 16.

The liquid ejection apparatus may be any suitable type other than the printer 10 that ejects ink. For example, the liquid ejection apparatus may be a printing device including a fax or a copier; a liquid ejection apparatus that ejects liquid such as electrode material or color material used in the manufacture of liquid crystal displays, EL displays, and surface emitting displays; a liquid ejection apparatus that ejects bioorganic matter used in the manufacture of biochips; or a liquid ejection apparatus as a precision pipette. Further, liquid other than the ink may be ejected by the liquid ejection apparatus.

The present examples and embodiments are to be considered as illustrative and not restrictive and the invention is not to be limited to the details given herein, but may be modified within the scope and equivalence of the appended claims.

The invention claimed is:

1. A liquid ejection apparatus comprising:

a liquid ejection head that has a nozzle-forming surface in which nozzle openings are defined and ejects a liquid through the nozzle openings;

a liquid receiver that has an opening corresponding to the nozzle openings and is capable of receiving the liquid ejected from the nozzle opening as a waste liquid;

a movement mechanism that moves the liquid receiver between a receiving position at which the liquid receiver is capable of receiving the waste liquid and a non-receiving position at which the liquid receiver is incapable of receiving the waste liquid, wherein the receiving position is a position at which the opening is closely opposed to the nozzle-forming surface, and wherein the non-receiving position is spaced from the receiving position; and a posture change inducing portion arranged on a movement path of the liquid receiver between the receiving position and the non-receiving position, wherein the posture of the liquid receiver is changed by containing the posture change inducing portion when the liquid receiver moves, wherein, when the liquid receiver moves from the receiving position to the non-receiving position, the posture change inducing portion changes the posture of the liquid receiver from a horizontal posture to a vertical posture, and wherein, when the liquid receiver moves from the non-receiving position to the receiving position, the posture change inducing portion changes the posture of the liquid receiver from the vertical posture to the horizontal posture.

2. The apparatus according to claim 1, further comprising a cap member movable between a contacting position at which the cap member is capable of contacting the liquid ejection head and a non-contacting position at which the cap member is incapable of contacting the liquid ejection head, the contacting position being set at a position coinciding with the receiving position, the non-contacting position being a position at which the cap member is spaced from the liquid ejection head, wherein the movement mechanism moves the liquid receiver from the non-receiving position to the receiving position after the cap member is moved from the contacting position to the non-contacting position.

3. The apparatus according to claim 2, wherein the non-contacting position is set immediately below the receiving position.

4. The apparatus according to claim 3, wherein, when located at the receiving position, the liquid receiver caps the cap member maintained at the non-contacting position from above.

5. The apparatus according to claim 1, further comprising a wiper member movable between a wiping position at which the wiper member is capable of wiping off the liquid from the nozzle-forming surface and a non-wiping position at which the wiper member is incapable of wiping off the liquid, the wiping position being set at a position coinciding with the receiving position, the non-wiping position being spaced from the wiping position, wherein the movement mechanism moves the liquid receiver from the non-receiving position to the receiving position after the wiper member is moved from the wiping position to the non-wiping position.

6. The apparatus according to claim 1, further comprising a carriage that has the liquid ejection head and is capable of reciprocating, wherein the movement mechanism moves the liquid receiver in a direction perpendicular to a direction in which the carriage reciprocates.

7. The apparatus according to claim 1, wherein, when located at the non-receiving position, the liquid receiver is maintained in a substantially vertical posture in which an opening of the liquid receiver is oriented laterally.

8. The apparatus according to claim 1, wherein a liquid absorber is accommodated in the opening of the liquid receiver.

9. The apparatus according to claim 1, further comprising:

a liquid drainage line connected to the liquid receiver; and a suction drainage device that draws the liquid from the liquid receiver and drains the liquid through the liquid drainage line.

10. The apparatus according to claim 1, wherein the movement mechanism includes a drive force transmitting member that operates at a constant position in a range between the receiving position and the non-receiving position when a drive force is generated, and a movable member that moves in the range between the receiving position and the non-receiving position through operation of the drive force transmitting member, and wherein the liquid receiver is capable of operating in association with the movable member in such a manner as to move between the receiving position and the non-receiving position in association with the movable member.

11. The apparatus according to claim 10, wherein the movable member includes a cap member or a wiper member, wherein the cap member is movable between a contacting position at which the cap member is capable of contacting the liquid ejection head and a non-contacting position at which the cap member is incapable of contacting the liquid ejection head, the contacting position being set at a position coinciding with the receiving position, the non-contacting position being a position at which the cap member is spaced from the liquid ejection head, and wherein the wiper member is movable between a wiping position at which the wiper member is capable of wiping off a liquid from the nozzle-forming surface and a non-wiping position at which the wiper member is incapable of wiping off the liquid, the wiping position being set at a position coinciding with the receiving position, the non-wiping position being spaced from the wiping position.

12. The apparatus according to claim 10, wherein the drive force transmitting member is a lead member that is shaped like an elongated bar and has a threaded portion formed in an outer circumferential surface of the lead member, the lead member rotating about the axis of the lead member when the drive force is generated, and wherein the movable member has an engagement portion that becomes engaged with the threaded portion, the movable member moving in the axial direction of the lead member through guiding of the engagement portion by the threaded portion when the lead member rotates.

13. The apparatus according to claim 12, wherein the threaded portion has a first threaded portion and a second threaded portion, and wherein the pitch of the first threaded portion is smaller than the pitch of the second threaded portion.

* * * * *